US006927697B2

(12) United States Patent
Yamaguchi

(10) Patent No.: US 6,927,697 B2
(45) Date of Patent: Aug. 9, 2005

(54) REMOTE CONTROL SYSTEM, TRANSMITTER AND PERIPHERAL UNIT FOR THE USE OF THE SYSTEM

(75) Inventor: Takashi Yamaguchi, Tokyo (JP)

(73) Assignee: Konami Corporation, Tokyo (JP)

( * ) Notice: Subject to any disclaimer, the term of this patent is extended or adjusted under 35 U.S.C. 154(b) by 280 days.

(21) Appl. No.: 10/179,348

(22) Filed: Jun. 25, 2002

(65) Prior Publication Data

US 2003/0156040 A1 Aug. 21, 2003

(30) Foreign Application Priority Data

Jan. 25, 2002 (JP) ..... 2002-017635

(51) Int. Cl.[7] ..... G08C 19/00; B61L 3/00; B60L 15/00

(52) U.S. Cl. ..... 340/825.69; 340/825.21; 246/187; 104/301

(58) Field of Search ..... 340/825.21–825.69; 246/4; 343/6.25

(56) References Cited

U.S. PATENT DOCUMENTS 4,207,569 A * 6/1980 Meyer ..... 342/44
4,335,381 A 6/1982 Palmer
4,723,737 A * 2/1988 Mimoun ..... 246/25
5,749,547 A * 5/1998 Young et al. ..... 246/4
5,896,017 A * 4/1999 Severson et al. ..... 312/280
6,039,291 A 3/2000 Dobson, IV
6,270,040 B1 8/2001 Katzer
2001/0020430 A1 9/2001 Lenz

* cited by examiner

*Primary Examiner*—Michael Horabik
*Assistant Examiner*—Scott Au
(74) *Attorney, Agent, or Firm*—Jordan and Hamburg LLP

(57) ABSTRACT

A remote control system for operating a drive unit 2 and a peripheral unit 3 to be used together with the drive unit by remote control, has a transmitter 1 that generates data repeatedly including a first control information for a specific operation of the drive unit 2 and a second control information for controlling a specific operation of the peripheral unit 3. The drive unit 2 controls its specific operation on the basis of the first control information and the peripheral unit 3 controls its specific operation on the basis of the second control information.

15 Claims, 24 Drawing Sheets

FIG.14

| SIGNALER | LIGHTING CONDITION | | | |
|---|---|---|---|---|
| A | ○ | ▨ | ▨ | ▨ |
| B | ▨ | ○ | ▨ | ▨ |
| C | ▨ | ▨ | ○ | ▨ |
| D | ▨ | ▨ | ▨ | ○ |
| CONDITION OF COURCE | COURSE A IS OK | COURSE B IS OK | COURSE C IS OK | COURSE D IS OK |

REMOTE CONTROL SYSTEM, TRANSMITTER AND PERIPHERAL UNIT FOR THE USE OF THE SYSTEM

BACKGROUND OF THE INVENTION

1. Field of the Invention

The present invention relates to a system for operating various devices such as a model train, a switching unit of a railroad on which the model train travels and a signal or the like by remote control.

2. Description of the Related Art

As a system for individually operating a drive unit and its peripheral unit by remote control with the data to be transmitted from a transmitter, for example, a system is known, which is disclosed in Japanese Patent Application Laid-Open No. 2000-197777. The remote control system described in this publication is provided with a model train as a drive unit, a switching unit for switching a track on which the model train travels as a peripheral unit and a transmitter for operating the model train and the switching unit by remote control. The transmitter repeatedly transmits the transmission data at a predetermined period. The transmission data of one frame to be transmitted for each time includes the identification information (an object code) for specifying for which the transmission data has been destined, the train model or the switching unit and the control information (a data code) for controlling the operation of the train model or the switching unit, which is designated by the identification information. The model train and the switching unit determine whether the transmission data is destined for themselves on the basis of the identification information that is included in the received data, respectively. Then, if they determine that the transmission data is destined for them, they control the operation on the basis of the control information that is included in the data. In this way, a plurality of model trains and switching units can be selectively and individually controlled on the basis of the transmission data, which is transmitted from one transmitter.

However, according to the above described remote control system, in order to transmit the transmission data for one frame, the model train and the switching unit to be operated by remote control should be alternatively selected. Therefore, the transmission data for one frame is only used for any one object to be controlled in the model train or the switching unit, so that the control information is not transmitted to other objects to be controlled. Accordingly, during the operation of the switching unit by remote control, the control information for the model train is not transmitted and it is not possible to operate the model train by remote control. Generally, it is often the case where the control of so-called peripheral unit such as the switching unit is needed accompanied by the operational control of a main drive unit such as the model train or the like, so that a user may want the main object to be controlled to be continuously controlled even during controlling of such as a peripheral unit. For example, the user may performs the operation so as to switch over the switches and a signaler in association with a traveling position and a traveling speed of a model train as continuously controlling the traveling of the model train. Therefore, for example, there is a scene where the user regulates the speed even in the process of switching over the switches. According to the conventional system, it is not possible to meet such a requirement.

SUMMARY OF THE INVENTION

The present invention has been achieved in order to solve the above problems. It is an object of the present invention to provide a remote control system capable of controlling a peripheral unit to be used together with a drive unit without interrupting the control of the drive unit and a transmitter suitable for the system.

The present invention will be described below.

In order to solve the above described problems, a remote control system according to the present invention comprises a remote control system for operating a drive unit and a peripheral unit to be used together with the drive unit, which are included in a receiving side group, by remote control with the data which are repeatedly transmitted from a transmitter; wherein the transmitter comprises: a data generating device for generating the data repeatedly so that the data include the first control information in association with an operational condition of a user with regard to a specific operation of the drive unit as well as generating the data so that the data include the first control information and the second control information for controlling a specific operation of the peripheral unit in the case where the user performs an operation with regard to the specific operation of the peripheral unit; and the receiving side group comprises: a drive unit control device which is provided in association with the drive unit and controls the specific operation of the drive unit on the basis of the first control information included in the data transmitted from the transmitter; and a peripheral unit control device which is provided in association with the peripheral unit and controls the specific operation of the peripheral unit on the basis of the second control information included in the data transmitted from the transmitter.

According to the remote control system of the present invention, the data to be repeatedly transmitted from a transmitter is received by the both of the drive unit and the peripheral unit. Then, the first control information contained in this data is used by the drive unit as well as the second control information is used by the peripheral unit. Accordingly, in the case of controlling the drive unit continuously, it is possible to control the peripheral unit without interrupting the control of the drive unit.

According to the present invention, single drive unit and single peripheral unit or plural drive units and plural peripheral units may be available. A single specific operation or plural specific operations or a combination of the plural operations may be available. For example, according to the drive unit for driving two motors which are provided to right and left driving wheels and realizing various traveling conditions due to the differences in rotation of the two motors, the operation of each motor may be a specific operation or the traveling operation realized by the two motors may be specific operation. The operation by the user with regard to the specific operation of the peripheral unit may designate the control amount of the operation of the peripheral unit or may switch over a mode which is set in the transmitter.

According to the remote control system of the present invention, the peripheral unit may be provided at the outside of the drive unit as an external device that is separately located independently from the drive unit. For example, in the case where a model train is defined as a drive unit in a railway model, a signaler for displaying a travel direction of the model train, a rudder for changing over a course of a track on which the model train travels or the switching unit provided with the signaler and the rudder may be defined as a peripheral unit.

According to the remote control system of the present invention, the peripheral unit may be provided as an internal device, which is built in the drive unit, and at least a portion of the drive unit control device and the peripheral unit control device is used in common therein. For example, in the case where a model train is defined as a drive unit in a railway model, a device to light a head lamp which is built in the model train and a device to sound a whistle may be defined as a peripheral unit.

According to the remote control system of the present invention, the transmitter may be provided with a mode changing operation device for receiving the mode changing operation by the user and a mode control device for selecting any one of the drive unit control mode and the peripheral unit control mode in association with the operational condition of this mode changing operation device; and the data generating device may generate the data so that the first control information reflects the operational condition of the user with regard to the specific operation of the drive unit in the case of the drive unit control mode, and in the case of the peripheral unit control may generate the data so that the second control information reflects the operational condition of the user with regard to the specific operation of the peripheral unit and a portion of the first control information maintains a condition included in the first control information before the peripheral unit control mode is selected not depending on the operational condition of the user under this mode. In this case, the user is capable of changing the operational environment of the transmitter into a mode corresponding to respective conditions in association with a condition mainly with respect to the operation of the drive unit and a condition mainly with respect to the operation of the peripheral unit. Accordingly, it is possible to continue the operation of the drive unit as well as it is possible to make the operation for controlling the peripheral unit easier. Alternatively, under the drive unit control mode, the second control information may be included in the drive unit control mode.

According to the remote control system of the present invention, the transmitter may be provided with a dual purpose operational device for receiving the user's operation with regard to the specific operation of the drive unit or the specific operation of the peripheral unit; and the data generating device may generate the data so that it receives the operation with regard to the dual purpose operational device as the operation with regard to the specific operation of the drive unit and a portion of the first control information reflects the operational condition with regard to the dual purpose operational device in the case of the drive unit control mode and may generate the data so that it receives the operation with regard to the dual purpose operational of the user device as the operation with regard to the specific operation of the peripheral unit, the second control information reflects the operational condition with regard to the dual purpose operational device and a portion of the first control information maintains a condition reflecting the operational condition of the dual purpose operational device before the peripheral unit control mode is selected in the case of the peripheral unit control mode. In this case, it is possible to partially use an input device of the transmitter to be operated for controlling the device unit under the drive unit control mode in order to control the peripheral unit under the peripheral unit control mode. Accordingly, it is possible to simplify a constitution of the transmitter. Further, a dual purpose operational device may be a device for deciding the control amount of the device unit or the peripheral unit or it may be a device for changing an object to be controlled.

According to the remote control system of the present invention, the transmitter may be provided with a drive unit operating device for receiving the user's operation with regard to the specific operation of the drive unit; and the data generating device may generate the data so that a portion of the first control information reflects the operation with regard to the drive unit operating device in any mode of the drive unit control mode or the peripheral unit control mode. In this case, even if the mode is switched to a peripheral unit control mode, it is possible to continuously control the main operation with respect to the drive unit. Accordingly, it is possible to improve the operationality in the control of the entirety of a receiving side group.

According to the remote control system of the present invention, the receiving side group in association with one transmitter may be capable of containing a plurality of the peripheral units; the transmitter may be provided with a selecting operation device for receiving the user's operation to designate a peripheral unit to be controlled among a plurality of peripheral units; the data generating device may generate the data so that the unit designating information for indicating the designation condition of an object to be controlled by the selecting operation device is included in the second control information; and the peripheral unit control device may determine whether itself is an object to be controlled or not on the basis of the unit designating information which is included in the second control information, may perform the control of the specific operation on the bases of the second control information when determining that itself is an object to be controlled and may withhold the control of the specific operation when determining that itself is not an object to be controlled. In this case, it is possible to continuously control the operation of the drive unit as well as it is possible to select and control the peripheral unit to be controlled among a plurality of peripheral units. Alternatively, a plurality of peripheral units may the same kind of peripheral units such as the plural switching units or they may be different kinds of peripheral units such as the switching unit and a device for sounding a whistle. In the data for one time, a single peripheral unit or a plurality of peripheral units may be designated as an object to be controlled. Upon designating an object to be controlled, in the cases that there are plural different kinds of peripheral units, a specific kind of peripheral unit may be designated or the different identification are allocated in the different kinds of peripheral units or in the same kind of peripheral units, so that it may be designated on the basis of the identification information. In the case where, for example, the identification information allocated to the peripheral unit is used, the unit designating information may be the information only including the identification information of the peripheral unit to be designated as an object to be controlled or the unit designating information may be the information obtained by combining the identification information and the information indicating whether the peripheral unit, to which this identification information is allocated, is designated as an object to be controlled or not.

According to the remote control system of the present invention, the receiving side group in association with one transmitter may be capable of containing a plurality of the drive units and a plurality of the peripheral units, respectively; the transmitter may be provided with a selecting operation device for receiving the user's operation to select arbitrary option among a plurality of options; the data generating device may generate the data so that it receives the operation with regard to the selecting operation device as the operation for designating a drive unit to be controlled among a plurality of the drive units and the drive unit specifying information indicating this designation condition is included in the first control information in the drive unit control mode, may generate the data so that it receives the operation with regard to the selecting operation device as the operation for designating a peripheral unit to be controlled among a plurality of the peripheral units and the unit designating specifying information indicating this designation condition is included in the second control information in the peripheral unit control mode and the drive unit specifying information maintains the drive unit specifying information before the peripheral unit control mode is selected not depending on the operational condition of the user with regard to the selecting operation device in the case of the peripheral unit control mode; the drive unit control device may determine whether itself is an object to be controlled or not on the basis of the device unit specifying information which is included in the first control information, may perform the control of the specific operation on the bases of the first control information when determining that itself is an object to be controlled and may withhold the control of the specific operation when determining that itself is not an object to be controlled; and the peripheral unit control device may determine whether itself is an object to be controlled or not on the basis of the unit designating information which is included in the second control information, may perform the control of the specific operation on the bases of the second control information when determining that itself is an object to be controlled and withhold the control of the specific operation when determining that itself is not an object to be controlled. In this case, if an input device, which is used for the operation to designate the drive unit to be controlled and which is relatively rarely operated, and an input device to be used for the operation of the peripheral unit to be used accompanied by the drive unit are used in common, it is possible to simplify the transmitter without losing the operationality upon controlling the entirety of the receiving side grope.

According to the remote control system of the present invention, the drive unit is constituted as a movable model, the drive unit control device may control the operation of the model on the basis of the first control information; and the peripheral unit may be set in a moving range of the model so that it is constituted as an external device for performing a predetermined operation. In this case, for example, according to a constitution that the mutual action is generated between the model train and the external device, it is possible to give a sense of reality to the operation of the model train and to increase a taste of the railroad model.

According to the remote control system of the present invention, the model may be a model train traveling along a track; the drive unit control device may control a traveling speed of the model train on the basis of the first control information; the peripheral unit may be a signaler for indicating a travel direction of the model train or a rudder capable of changing over a track on which the model train travels; and the peripheral unit control device may control the indication change operation of the signaler or the track change operation of the rudder as the specific operation of the peripheral unit on the basis of the second control information. In this case, it is possible to control the entirety of the railroad model including a model train and the switching unit by one transmitter, so that it is possible to increase a taste of the railroad model.

According to the remote control system of the present invention, the model may be a model train traveling along a track; the drive unit control device may control a traveling speed of the model train on the basis of the first control information; the peripheral unit may be a switching unit which is provided with a signaler for indicating a travel direction of the model train and a rudder capable of changing over a track on which the model train travels; and the peripheral unit control device may control the indication change operation of the signaler on the basis of the second control information as well as controls the track change operation of the rudder accompanied by the indication change operation of the signaler. In this case, a track is changed over accompanied by the display of the signaler, so that the user is capable of easily setting a track, on which the model train travels, and it is possible to increase a taste of the railroad model.

The remote control system of the present invention comprises a transmitter for operating a drive unit and a peripheral unit to be used together with the drive unit, which are included in a receiving side group, by remote control with the data transmitted repeatedly thereby; wherein the transmitter is provided with a data generating device for generating the data repeatedly so that the data include the first control information in association with an operational condition of a user with regard to a specific operation of the drive unit as well as it generates the data so that the data include the first control information and the second control information for controlling a specific operation of the peripheral unit in the case where the user performs an operation with regard to the specific operation of the peripheral unit. By combining this transmitter, the drive unit to perform the operational control on the basis of the first control information, which is contained in the data transmitted from the transmitter, and the peripheral unit to perform the operational control on the basis of the second control information, it is possible to realize the remote control system according to the present invention.

Alternatively, the transmitter according to the present invention may also include various preferable embodiments as described above. In other words, the transmitter maybe provided with a mode changing operation device for receiving the mode changing operation by the user and a mode control device for selecting any one of the drive unit control mode and the peripheral unit control mode in association with the operational condition of this mode changing operation device; and the data generating device may generate the data so that the first control information reflects the operational condition of the user with regard to the specific operation of the drive unit in the case of the drive unit control mode and, in the case of the peripheral unit control mode may generate the data so that the second control information reflects the operational condition of the user with regard to the specific operation of the peripheral unit and a portion of the first control information maintains a condition included in the first control information before the peripheral unit control mode is selected not depending on the operational condition of the user under this mode. Further, the receiving side group in association with the transmitter may be capable of containing a plurality of the peripheral units; the transmitter may be provided with a selecting operation device for receiving the user's operation to designate a peripheral unit to be controlled among a plurality of peripheral units; and the data generating device may generate the data so that the unit designating information for indicating the designation condition of an object to be controlled by the selecting operation device is included in the second control information.

Alternatively, the peripheral unit of the present invention to be used as combined with the above described transmitter is characterized in that the peripheral unit is provided with a peripheral unit control device which determines whether itself is an object to be controlled or not on the basis of the unit designating information which is included in the data from the transmitter, performs the control of the specific operation on the bases of the second control information when determining that it self is an object to be controlled and withholds the control of the specific operation when determining that itself is not an object to be controlled.

BRIEF DESCRIPTION OF THE DRAWINGS

FIG. 14 is a view for illustrating the association of a signal and a course in the switching unit;

DETAILED DESCRIPTION OF THE INVENTION

Figure 1:
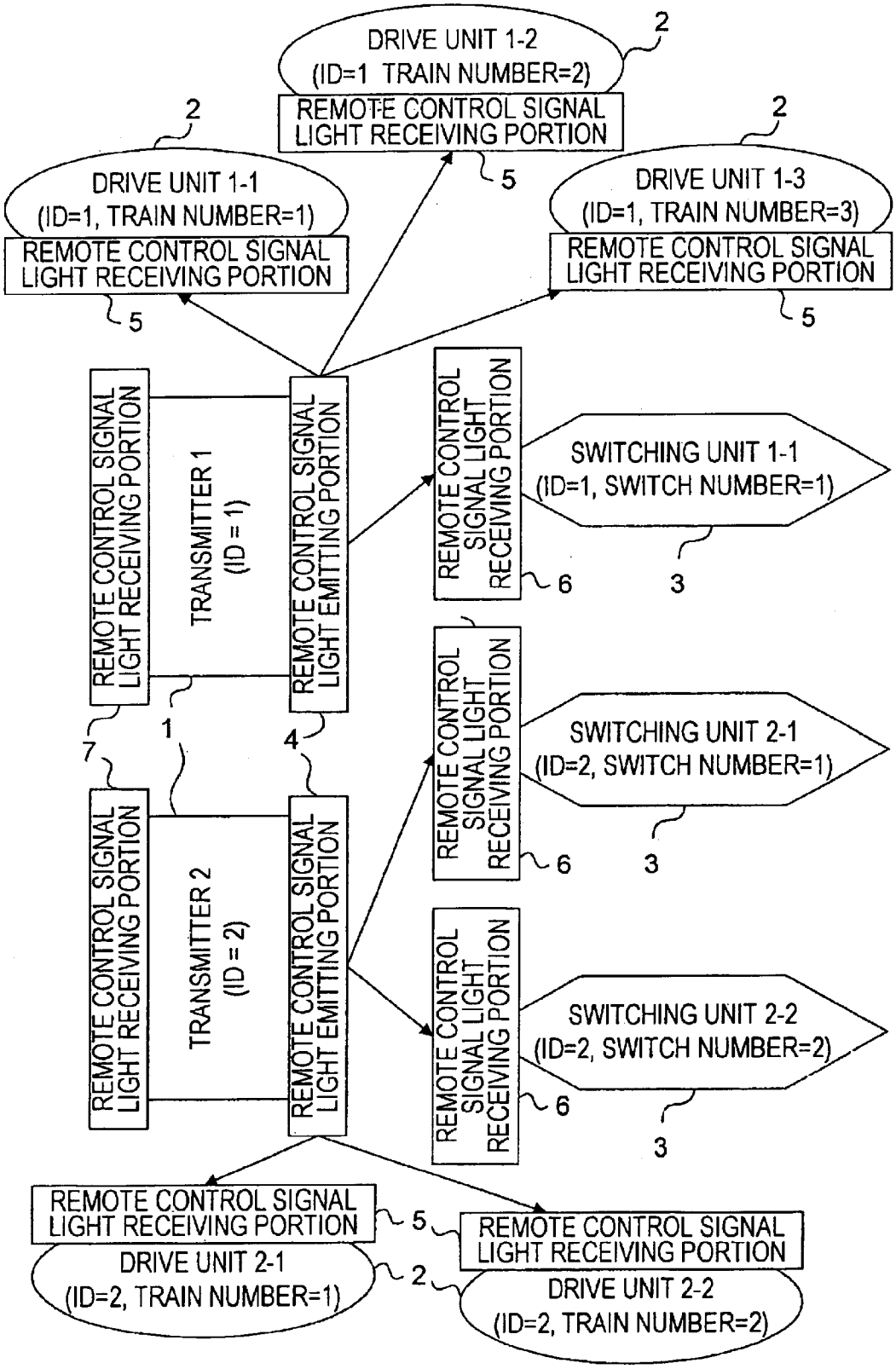
FIG. 1 is a diagram for illustrating a schematic constitution of a remote control system according to the present invention.

FIG. 1 is a diagram for illustrating a schematic constitution of a remote control system according to the present invention. In FIG. 1, it is supposed that two transmitters 1, 1 control five drive units 2 . . . 2 and three switching units 3 . . . 3 as a peripheral unit which are included in the receiving side group are operated by remote control as being distinguished each other at the same place. Here, the switching unit 3 is an external device that is separately set independently of the drive unit.

In respective transmitter 1, the drive unit 2 and the switching unit 3, as the transmitter specifying information, any one ID code of 1 to 4 is set. Alternatively, in respective transmitter 1 and the drive unit 2, as the drive unit specifying information, any one train number of 1 to 8 is set and in the switching units 3 . . . 3, any one switch number of 1 to 8 is set. According to the present embodiment, a combination of the ID code and the train number functions as the identification information to associate the transmitter 1 and the drive unit 2 each other and a combination of the ID code and the switch number functions as the identification information to associate the transmitter 1 and the switching unit 3 each other. For the remote control of respective drive units 2 and respective switching units 3, infrared radiation is employed. Therefore, a remote control signal light emitting portion 4, a remote control signal light receiving portion 5 and a remote control signal light receiving portion 6 are installed in each transmitter 1, each drive unit 2 and each switching unit 3, respectively. Further, in order to synchronize the data transmission from each transmitter 1, a remote control signal light receiving portion 7 is installed in each transmitter 1.

Figure 2:
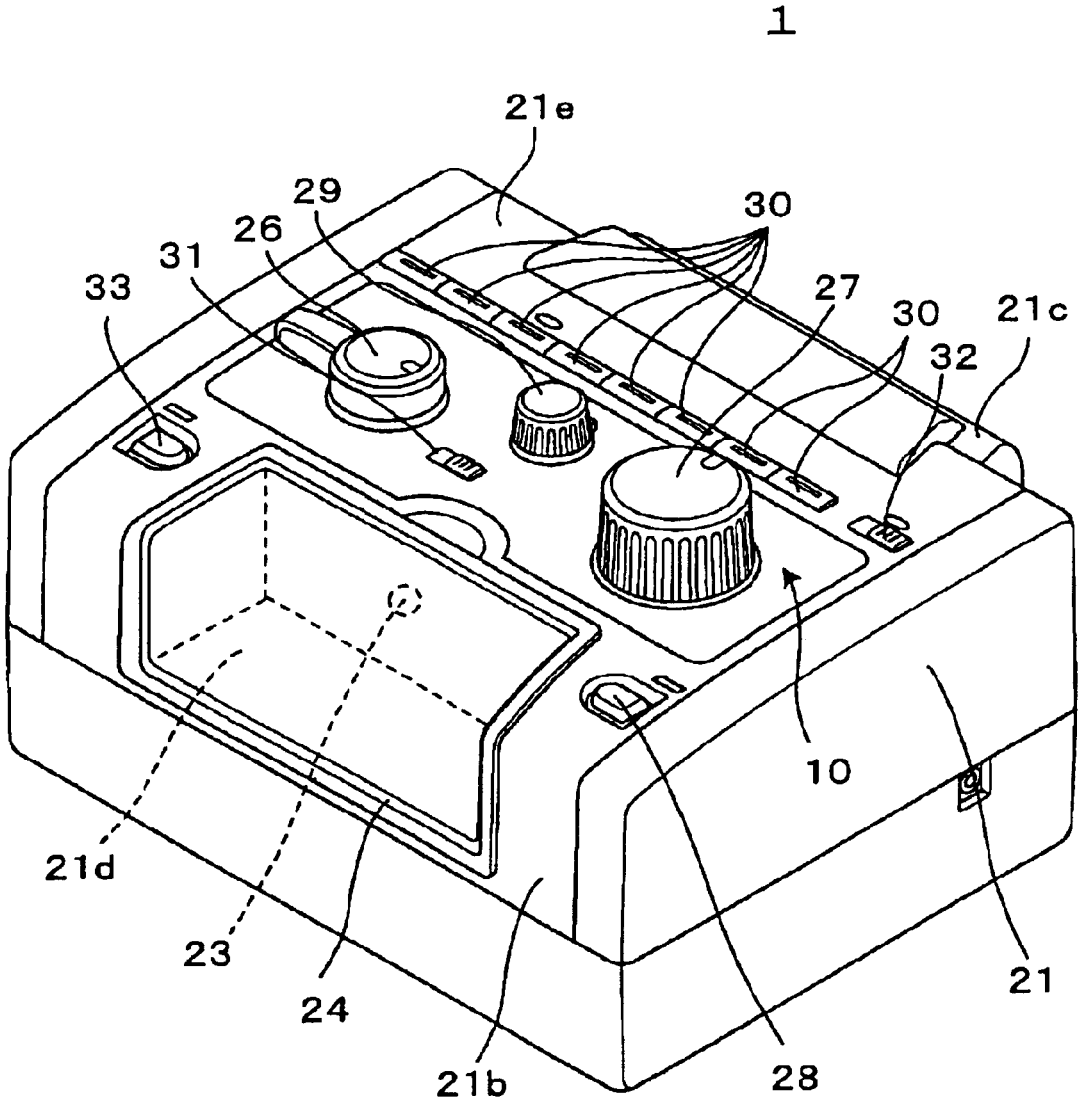
FIG. 2 is a perspective view for illustrating an appearance of a front surface side of a transmitter.
Figure 3:
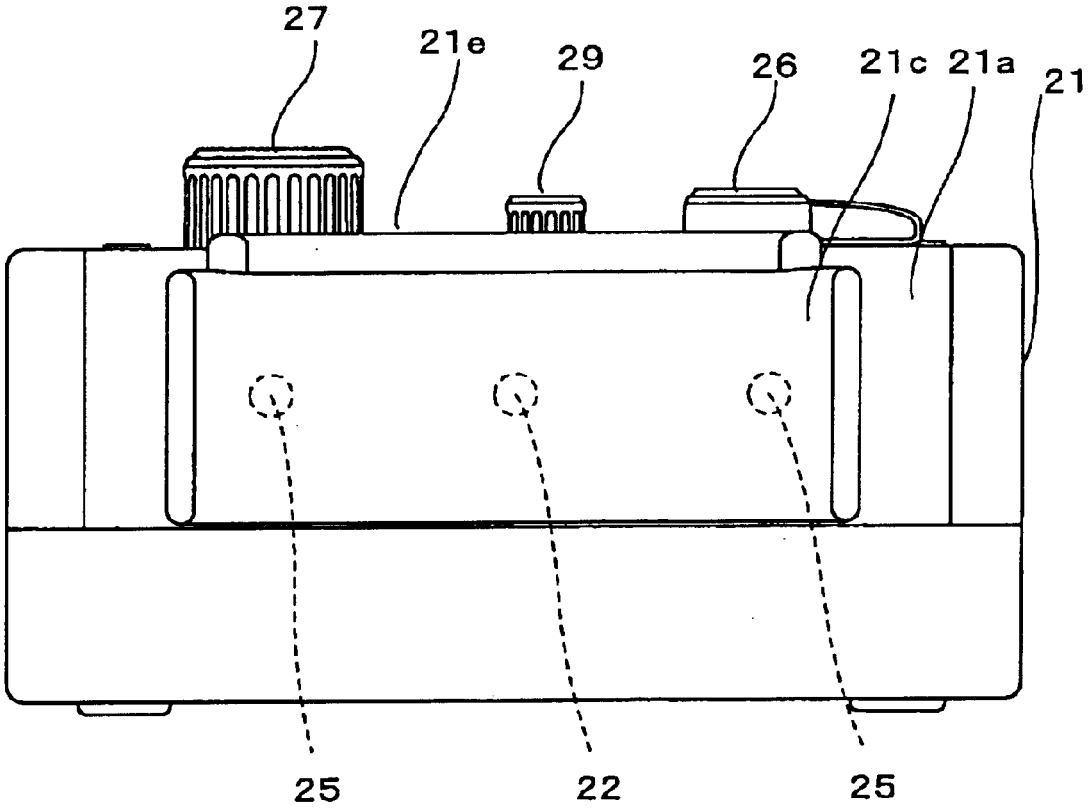
FIG. 3 is a rear view of the transmitter.
Figure 8:
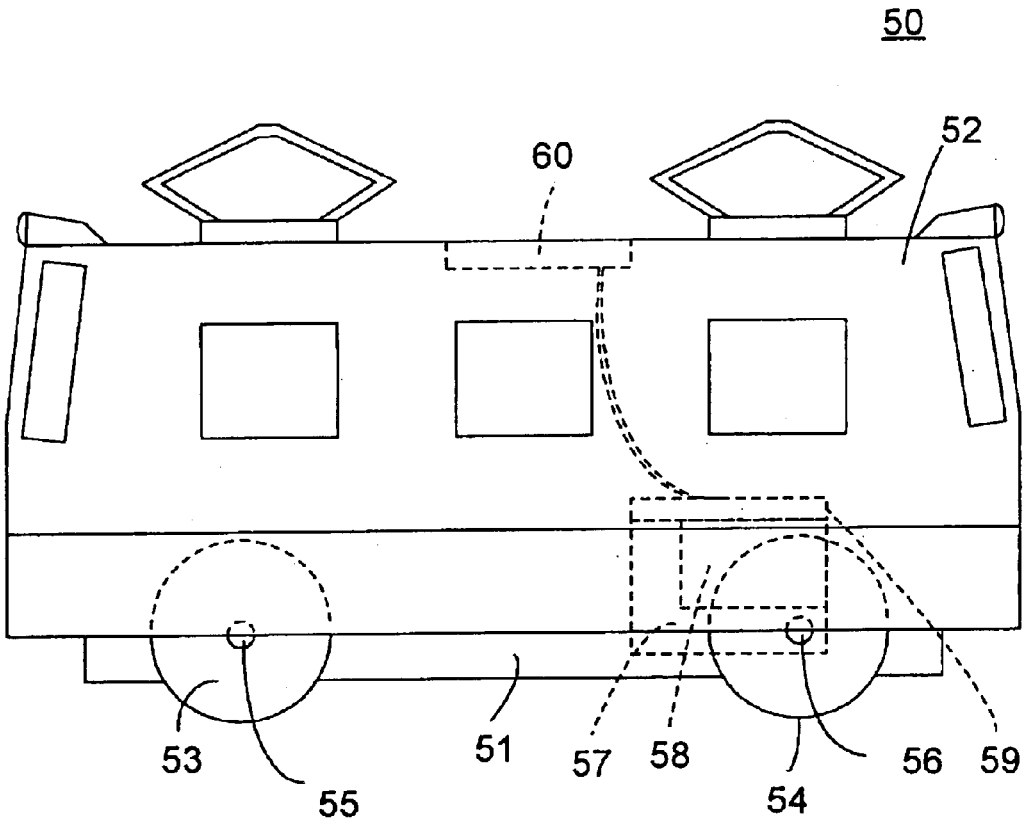
FIG. 8 is a view for illustrating a model train as an example of a drive unit.
Figure 10:
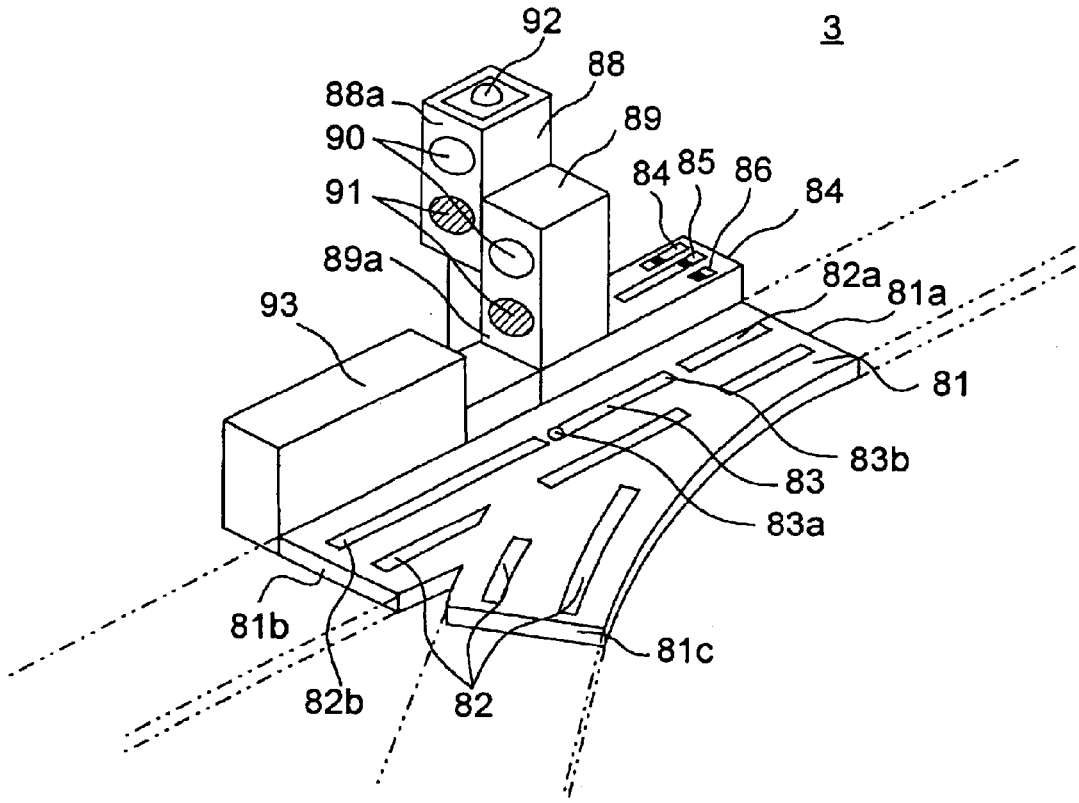
FIG. 10 is a perspective view for illustrating an appearance of a switching unit.

As shown in FIG. 2 and FIG. 3, the transmitter 1 is provided with an input device 10 for receiving the operation by the user, so that it transmits the data in association with the operation by the user. As shown in FIG. 8, the drive unit 2 is constituted as a compact model train 50 and it is provided with a motor 58 as a driving source and a control portion 59 for controlling the motor 58. As shown in FIG. 10, the switching unit 3 is constituted as a track element for constructing a track on which the model train 50 travels and the switching unit 3 is provided with signalers 88, 89 for indicating a travel direction of the model train 50 and a rudder 83 for switching over the travel direction of the model train 50. The switching unit 3 changes the lighting conditions of the signalers 88, 89 on the basis of the data from the transmitter 1 and then, it changes a position of the rudder 83 as shown in FIG. 11. Hereinafter, the details of the transmitter 1, the drive unit 2 and the switching unit 3 will be described with reference to the drawings, respectively.

FIG. 2 and FIG. 3 illustrate the details of the transmitter 1. FIG. 2 is a perspective view from a front surface side (i.e. a user side) of the transmitter 1 and FIG. 3 is a rear view of the transmitter 1. As shown in these drawings, the transmitter 1 has a steel case 21, which is made of a resin or the like. At a rear surface 21*a* of the steel case 21, a remote control signal light emitting portion 22 (corresponding to the remote control signal light emitting portion 4 shown in FIG. 1) for transmitting the data to the drive unit 2 is provided and at an anterior surface side 21*b* of the steel case 21, a remote control signal light emitting portion 23 for transmitting the data to rewrite the identification information of the drive unit 2 is provided. At the rear surface 21*a*, a cover 21*c*, through which the infrared radiation permeates, is provided and the remote control signal light emitting portion 23 is disposed in the inner side of this cover 21*c*. Alternatively, in the inside of the cover 21*c*, as the remote control signal light receiving portion 7 shown in FIG. 1, light receiving portions 25, 25 are also disposed.

Figure 4:
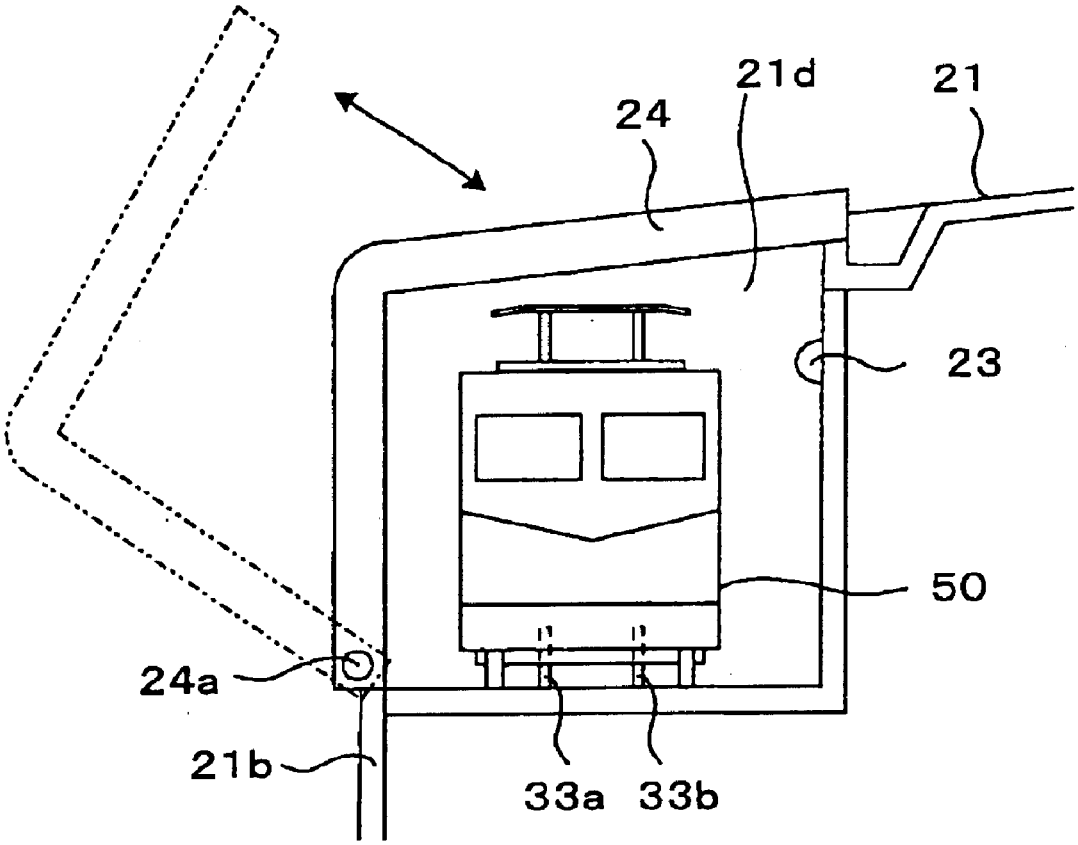
FIG. 4 is a sectional view of a fallen part that is provided on the front surface side of a transmitter.

As shown in FIG. 4, at the anterior surface side 21*b* of the steel case 21, a fallen portion 21*d* is formed and this fallen portion 21*d* is closed by a lid 24. The lid 24 can be released toward the anterior surface side centering on a hinge portion 24*a* at its lower end. The remote control signal light emitting portion 23 is provided on a wall surface of the fallen portion 21*d*. At a bottom of the fallen portion 21*d*, terminals 33*a* and 33*b* for the electrical charge are disposed. These terminals 33*a* and 33*b* serve to charge batteries incorporated in the model train 50 by contacting the terminals for the electrical charge of the model train 50 (see FIG. 8) as a drive unit 2 which is installed in the fallen portion 21*d*.

As shown in FIG. 2, at an upper surface 21*e* of the steel case 21, a F/R switch 26 to be operated for switching over the forward travel and the reverse travel of the drive unit 1 as the input device 10, a speed control volume 27 to be operated for setting the speed, are writing control switch 28 to be operated for instructing the rewriting of the identification information to the drive unit 2, an ID code setting switch 29 to be operated for setting the ID code of the transmitter 1, number selecting switches 30 . . . 30 to be operated for designating the train numbers or controlling the switching unit, a mode changing over switch 31 for changing over the intended purposes of the number selecting switches 30 . . . 30, a power supply switch 32 and a electrical charge switch 33 are provided.

The F/R switch 26 can be switched to the forward position or the reverse position and it outputs a signal in association with these positions. The speed control volume 27 outputs a speed designation signal in proportion to the operation amount of the rotation from an initial position in association with the speed 0. The rewriting control switch 28 is a push button type switch and if the pushing operation is performed, it outputs an on signal. The ID code setting switch 29 can be switched between four positions in association with the ID codes of 1 to 4 and it outputs a signal in association with these positions. It is possible to select the ID of the transmitter 1 between 1 to 4 by the switching operation of the ID code setting switch 29. The number selecting switch 30 is a push button type switch and it outputs an on signal in association with its pushing operation. The mode changing over switch 31 can be switched between two positions in association with a normal mode to designate a train number by the number selecting switch 30 . . . 30 and a switch control mode to control the switching units 3 . . . 3 by the number selecting switches 30 . . . 30 and it outputs a signal in association with these positions. In this case, eight number selecting switches 30 are provided. In the case where the mode changing over switch 31 is located at a normal mode position, the selecting switches 30 correspond to the train numbers of 1 to 8 at 1 to 1. By pushing any one of the number selecting switches 30, it is possible to select the train number in association with this number selecting switches 30. Alternatively, in the case where the mode changing over switch 31 is located at a switch control mode position, the number selecting switches 30 correspond to the switch numbers of 1 to 8 at 1 to 1. By pushing any one of the number selecting switches 30, it is possible to control the switching unit, in which the switch number in association with this number selecting switches 30 is set.

Figure 5:
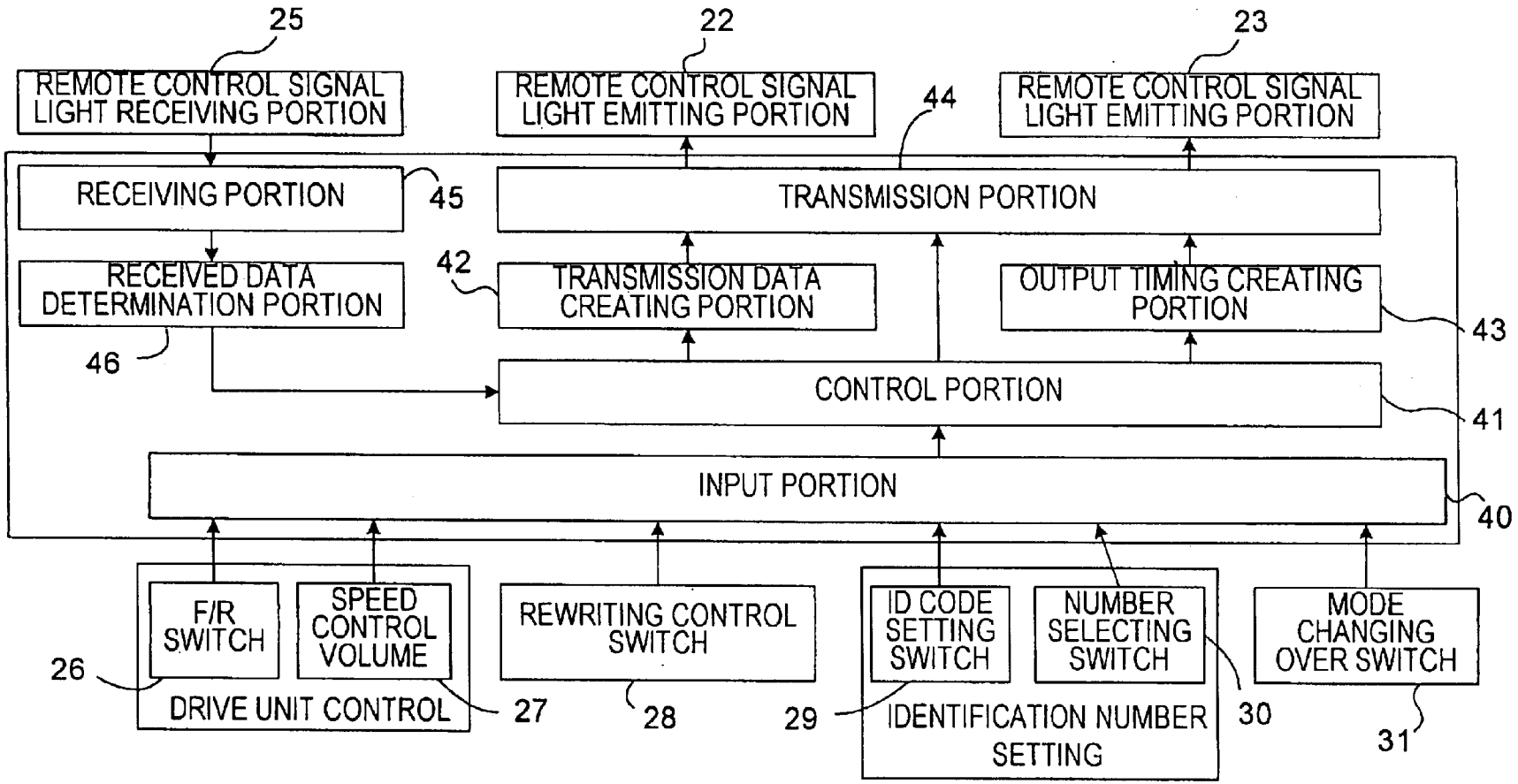
FIG. 5 is a functional block view of the transmitter.

FIG. 5 illustrates a circuit constitution of the transmitter 1. The signals in association with the operations of the input devices 26 to 31 are inputted in a control portion 41 through an input portion 40. On the basis of the signal from the input portion 40, the control portion 41 outputs a signal for creating the transmission data to a transmission data creating portion 42 as well as it outputs a signal for giving a timer setting value to an output timing creating portion 43. Alternatively, the control portion 41 determines whether it should transmit the data for the operational control of the drive unit 2 or it should transmit the data for changing the identification information on the basis of the mode selected by the mode changing over switch 31 and the switching condition of the rewriting control switch 28. Then, the control portion 41 outputs a signal to the transmission portion 44 so as to drive the remote control signal light emitting portion 22 in the case of transmitting the data for the operational control of the drive unit 2, and so as to drive the remote control signal light emitting portion 23 in the case of transmitting the data to instruct the change of the identification information.

The transmission data creating portion 42 creates the transmission data on the basis of a signal from the control portion 41 and outputs it to the transmission portion 44. On the other hand, an output timing creating portion 43 counts a time in accordance with a timer setting value which has been given from the control portion 41 and if a predetermined time in association with the timer setting value has passed, the output timing creating portion 43 outputs a signal for instructing the transmission portion 44 to transmit the data. The transmission portion 44 adds the modulation by a remote control signal carrier signal to the data from the transmission data creating portion 42 and it drives the remote control signal light emitting portion 22 or 23 in accordance with the timing which is instructed by the output timing creating portion 43. In this case, on the basis of a signal from the control portion 41, any one of the remote control signal light emitting portion 22, 23 is driven. The remote control signal light emitting portion 22, 23 are constituted including, for example, a light emitting device such as a LED or the like and they emit the infrared light in accordance with the instruction from the transmission portion 44, respectively. Here, frequencies of the infrared light carrier signals to be outputted from the remote control signal light emitting portion 22, 23 are the same in the all of the transmitters 1. Alternatively, the bit number of the remote control data for one block to be generated by the transmission data creating portion 42 is always fixed and further, time required for transmitting the remote control data for one block is also fixed.

The light receiving portion 25 receives the infrared light transmitted from other transmitter 1 and then, it outputs a signal that a carrier component is removed from this received infrared light to a receiving portion 45. The receiving portion 45 decodes a signal that is supplied from the light receiving portion 25 into the remote control data for one block and then, it outputs it to a received data determination portion 46. The received data determination portion 46 determines the ID code (see FIG. 7) of the received data supplied from the receiving portion 45 and then, it gives this determination result to the control portion 41. The control portion 41 sets a timer setting value to be given to the output timing creating portion 43 on the basis of a signal to be supplied from the received data determination portion 46 and from the input portion 40. In order to prevent the interference by the synchronous transmission of the remote control data from a plurality of transmitters 1, the transmission data is received from other transmitter 1 to set the outputting timing in this way.

Alternatively, using the remote control signal light emitting portion 22, 23 in common, any of the remote control data for the operational control of the drive unit 2 and the data for rewriting the identification information may be transmitted from the same light emitting portion.

It is preferable that the control portion 41 is constituted by the combination of the microcomputer and a predetermined program. The transmission data creating portion 42, the output timing creating portion 43, the transmission portion 44, the receiving portion 45 and the received data determination portion 46 may be constituted as a logical circuit and they may be constituted by the combination of the microcomputer and a predetermined program the same as the control portion 41. Further, at least one of the transmission data creating portion 42, the output timing creating portion 43 and the received data determination portion 46 may be integrated into the control portion 41.

Figure 6A:
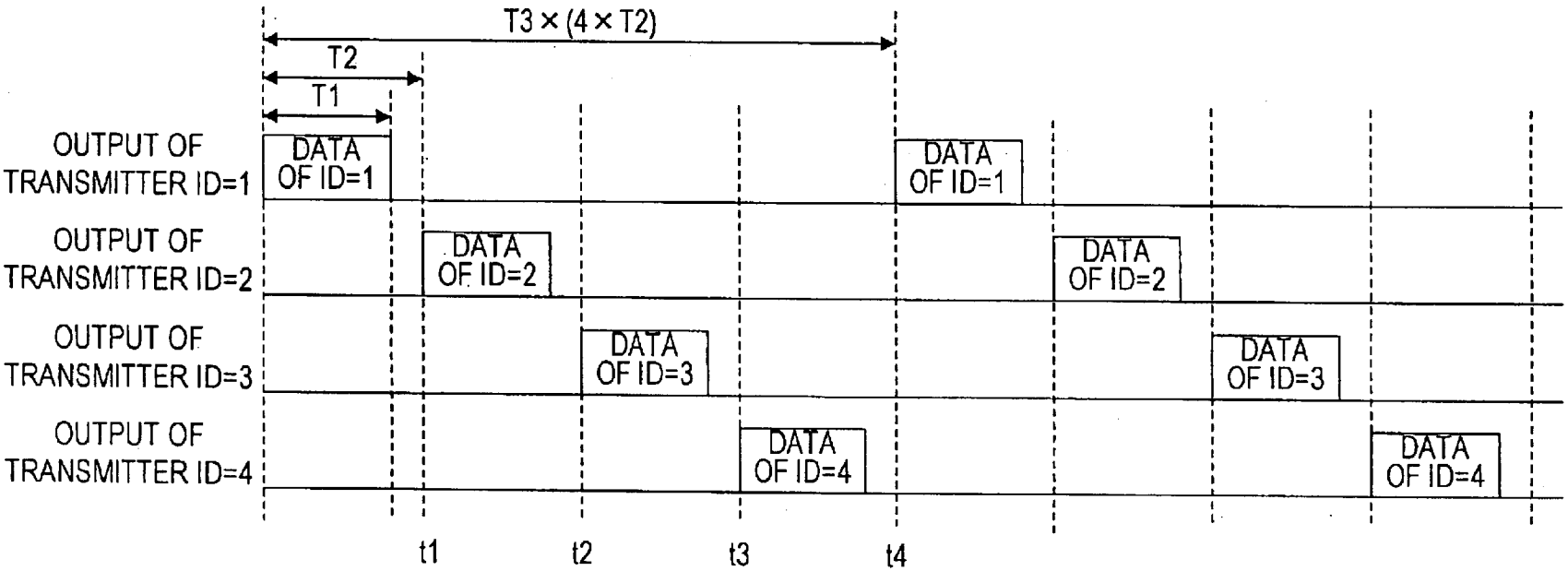
FIG. 6 is a view for illustrating a condition that the data is transmitted from the transmitter.

FIG. 6A illustrates how to get the transmission timing in the case where four transmitters 1 are simultaneously used. As being obvious from FIG. 6A, the light emitting timing of the infrared light from the remote control signal light emitting portion 22 is set at the times which are different with each other in association with the ID code to be set in common with the transmitter 1, the drive unit 2 to be controlled by the transmitter 1 and the switching unit 3.

A time length that one transmitter 1 transmits a remote control signal is defined as T1 and respective transmitters 1 transmit the data at a time period T2 when they are allowed to transmit the data. Respective transmitters 1 repeat the transmission of the remote control signals at a frequency T3 corresponding to the number of the transmitters 1×a time length T2 (=4×T2). Alternatively, the transmission timing of respective transmitters 1 are sequentially shifted from ID code=1 by T2. In accordance to such a relation, respective transmitters 1 manage the transmission timing, so that it is possible to prevent the transmission times from four transmitters 1 from being overlapping. In order to realize such transmission control, for example, the transmitter 1 of ID code=2 shown in FIG. 6A may control the transmission timing as follows.

At first, in the case where the transmitter 1 receives the data of ID code=1 at a time t1, subsequently, it starts to output the transmission data of itself and completes the output of the transmission data of itself before a time t2. When the transmission has completed, the transmitter 1 checks the reception data of the receiving portion 45 (see FIG. 5) to check that the interference of the signal is not generated. After that, the transmitter 1 sets a transmission timer for counting the next output timing after T3−T1 to start the timer count.

In the case where the remote control data of ID code=3 is received at a time t3, the transmitter 1 resets the transmission timer after 2×T2 to start the timer account. In the case where the remote control data of ID code=4 is received at a time t4, the transmitter 1 resets the transmission timer after T2 to start the timer account.

After that, in the case where a power supply of the transmitter 1 of ID code=1 can not be turned off, or in the case where the data from the transmitter 1 of ID code=1 is not received because of noise or the like, the output of the data of itself may be started at a time when the count of the transmission counter progresses by a time T2 after the data of ID code=4 is received. Further, even in the case where a signal from other transmitter 1 cannot be received, it is possible to continue the output of the transmission data at a period T3 by the use of a time T3−T1 set in the transmission timer when the transmission of the own data is completed.

Although the case of four transmitters 1 is explained here, it is also possible to control the transmission data by adding the ID code in the same way, even in the case of five transmitters 1. A period of the transmission timing of each transmitter 1 is N×T2 (N is the number of the transmitters). However, an entire period may be shortened by getting rid of spaces lying between the times when respective transmitters transmit the data.

On the other hand, a transmission timing of the data from the remote control signal light emitting portion 23 shown in FIG. 5 is set continuously (in this example, continuously, three times) differently from a manner to gain the transmission timing from the remote control signal light emitting portion 22.

Figure 7:
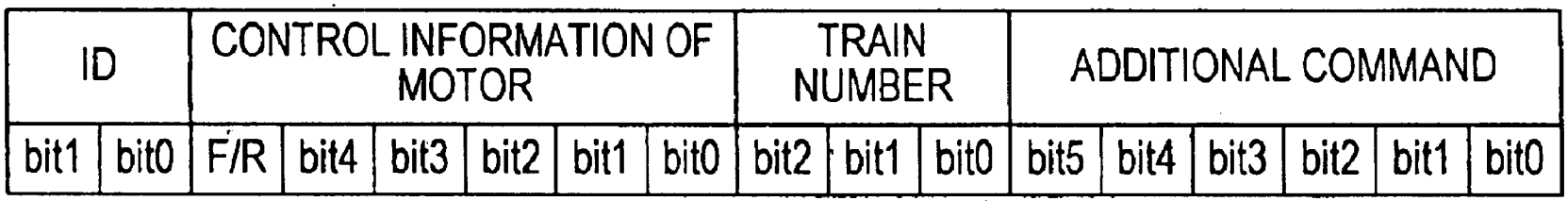
FIG. 7 is a view for illustrating a content of the remote control data for one block.

FIG. 7 is a view for illustrating a content of the remote control data for one block, which is generated by the transmission data creating portion 42. The remote control data for one block is composed of an ID code as the first control information, the control information of the motor 58 (see FIG. 8), the train number and an additional command as the second control information. Further, the control information of the motor is composed of the information for determining which the rotational direction of the motor is, a forward direction or a reverse direction (F/R determination) and the information for designating the driving speed of the motor. In the ID cord portion, the data of two bits corresponding to the ID code, which is selected by the ID code setting switch 29, is set. In the F/R determination portion of the motor, the data of one bit to indicate whether the F/R switch 26 is set in the forward direction or the reverse direction and in the motor control information portion, the data of five bits is set to designate the speed corresponding to the operational amount of the speed control volume 27. In the train number portion, the data of three bits is set to designate any one train number of 1 to 8 to be selected by the number selecting switches 30. However, in the case where the switch control mode is selected by the mode changing over switch 31, the train number, which has been selected just before the mode is switched to the switch control mode, is set. The additional command portion is composed of five bits and a code to designate an additional function is set therein according to need. A code to be set in the additional command is shown in a table 1.

[Table 1]

In the table 1, a line of a code (A) represents a code of the additional command in the case where a normal mode is selected by the mode changing over switch 31 and the rewriting control switch 28 is not pushed. In this case, a code of the additional command is 0000xx. Alternatively, the code of xx is used for setting an optional port.

In the table 1, a line of a code (B) represents a code of the additional command in the case where a normal mode is selected by the mode changing over switch 31 and the rewriting control switch 28 is pushed. In this case, a code of the additional command is 010101.

In the table 1, lines of a code (C) and a code (D) represents a code of the additional command in the case where a switch control mode is selected by the mode changing over switch 31. In this case, a code of the additional command is 10abcd or 11abcd and the additional command functions as the second control information containing the unit designating information. The remote control data light emitting portion 22 alternately transmits the transmission data for one block in which a code of 10abcd is set and the transmission data for one block in which a code of 11abcd is set. At the code of 10abcd, respective bits of abcd correspond to the switch numbers 1 to 4, respectively and at the code of 11abcd, respective bits of abcd correspond to the switch numbers 5 to 8. If any one of the number selecting switches 30 is pushed, the corresponding bit of abcd code becomes 1 (on).

FIG. 8 is a side view for illustrating one embodiment of the drive unit 2. According to the present embodiment, the drive unit 2 is constituted as the compact model train 50. This model train 50 has a chassis 51 and a body 52 that covers this chassis 51. At a center of a front portion of the chassis 51, a front wheel 53 is provided and at a rear portion, a rear wheel 54 is provided. The front wheel 53 is attached to the chassis 51 rotatably through an axel 55. The rear wheel 54 is attached to a transmission device 57 through an axel 56. The transmission device 57 transmits the rotation of the motor 58 as a driving source to the axel 56. Above the transmission device 57 and the motor 58, for example, the control portion 59 configured as a one chip microcomputer is disposed. The control portion 59 controls the operation of the motor 58 on the basis of the data to be transmitted from a remote control signal light receiving portion 60, which is attached to the body 52.

Figure 9:
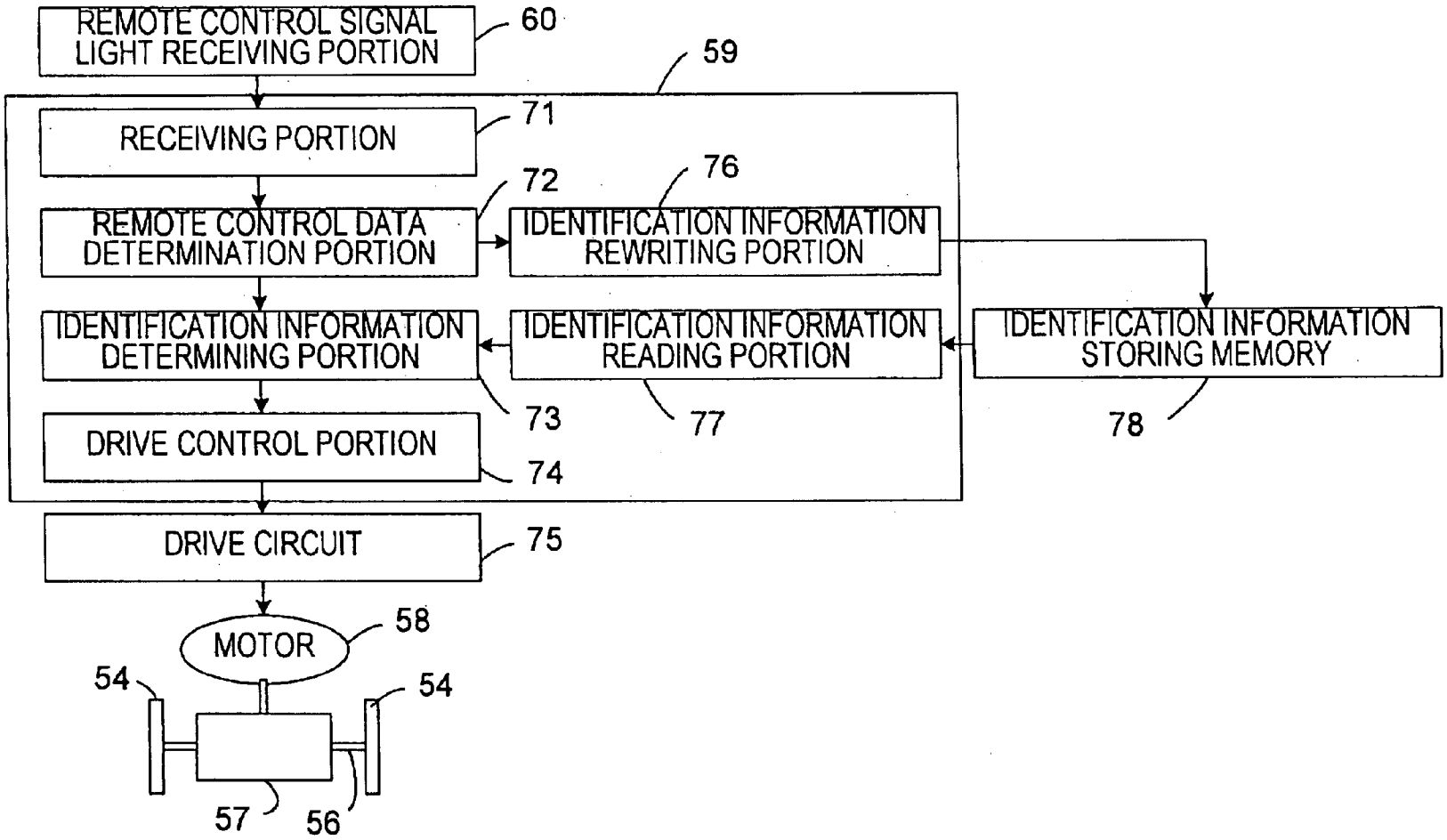
FIG. 9 is a functional block view of the model train shown in FIG. 8.

FIG. 9 illustrates a circuit constitution of a control system that is installed in the model train 50. As described above, the model train 50 is provided with the remote control signal light receiving portion 60. The remote control signal light receiving portion 60 receives the infrared light that is transmitted from the transmitter 1 and it outputs a signal that a carrier component is removed from this received infrared light to a receiving portion 71. The receiving portion 71 decodes a signal that is supplied from the remote control signal light receiving portion 60 into the remote control data for one block and then, it outputs it to a remote control data determination portion 72. The remote control data for one block is as shown in FIG. 7 and the table 1. The remote control data determination portion 72 determines whether the additional command of the received data that it supplied from the receiving portion 71 is 010101 or not, namely, it determines whether the received data is the data for instructing rewriting of the identification information or the data for controlling the operation of the drive unit 2.

In the case where the remote control data determination portion 72 determines that the received data is the data for controlling the operation of the drive unit 2, an identification information reading portion 77 reads the identification information of itself, which is stored in an identification information storing memory 78, and an identification information determining portion 73 compares the identification information which is contained in the received data with the identification information of itself. Then, if the identification information are identical with each other, the received data is sent to a drive control portion 74. Further, the a drive control portion 74 supplies a motor drive signal to a drive circuit 75 on the basis of the motor control information which is contained in the received data. The drive circuit 75 drives a motor 58 in accordance with a motor drive signal, which is supplied to the drive circuit 75.

On the other hand, if the remote control data determination portion 72 determines that the received data is the data for instructing rewriting of the identification information, the identification information (composed of the ID code and the train number) which is contained in this data is written in the identification information storing memory 78 by an identification information rewriting portion 76. Therefore, the identification information that is written in the identification information storing memory 78 is changed.

It is preferable that, for example, an involatile memory such as a EEPROM or the like is employed as the identification information storing memory 78 so that the identification information can be held without backup of the power supply. The receiving portion 71, the remote control data determination portion 72, the identification information determining portion 73, the drive control portion 74, the drive circuit 75, the identification information rewriting portion 76 and the identification information reading portion 77 maybe constituted as a logic circuit or they are constituted by the combination of the microcomputer and a certain program. Alternatively, an identification information determining portion, an identification information reading portion and an identification information storing memory may be provided between the receiving portion 71 and the remote control data determination portion 72 differently from the identification information determining portion 73, the identification information reading portion 77 and the identification information storing memory 78, so that the received data may be selected before transmitting the data to the remote control data determination portion 72.

FIG. 10 is a perspective view for illustrating the details of the switching unit 3. As shown in FIG. 10, the switching unit 3 has a track element 81, on which the model train 50 travels. The track element 81 has connecting portions 81*a*, 81*b* and 81*c*, to which other track elements are connected, so that the track element 81 can be used as a portion of an entire track on which the model train 50 travels. Alternatively, the track element 81 serves as a branch road, on which a straight course for connecting the connecting portions 81*a* and 81*b* and a curve course for connecting the connecting portions 81*a* and 81*c* are combined. On the upper surface of the track element 81, fallen portions 82 . . . 82 for guiding the front wheel 53 and the rear wheel 54 of the model train 50 and the rudder 83 for switching over the travel direction of the model train 50 are disposed. Two fallen portions 82, 82 are provided in parallel in such a manner that a width from one outside to other outside is slightly larger than a width from one inside to other inside of the front wheels 53, 53 and a width from one inside to other inside of the rear wheels 54, 54. Accordingly, the model train 50 travels as contacting the inside of the front wheel 53 and the rear wheel 54 and the outside of the fallen portion 82, so that, it is guided to a direction along the fallen portion 82. In this case, the fallen portion 82 is provided with branch so that it is capable of guiding the front wheel 53 and the rear wheel 54 to the both of the straight course for connecting the connecting portions 81*a* and 81*b* and the curve course for connecting the connecting portions 81*a* and 81*c*.

On a side surface of the track element 81, a drive box 84 for storing a motor for driving the rudder 83 and a microcomputer for controlling the motor or the like are provided. On the upper surface of the drive box 84, an ID code setting switch 85 for setting the ID code, a switch number setting switch 86 for setting the switch number and a power supply switch 87 are provided. The ID code setting switch 85 can be changed over between four positions corresponding to the ID codes of 1 to 4 and it outputs the signals corresponding to these positions. The switch number setting switch 86 can be changed over between eight positions corresponding to the switch numbers of 1 to 8 and it outputs the signals corresponding to these positions.

Alternatively, above the drive box 84, signalers 88, 89 for indicating a course of the model train 50 are provided. On the surfaces 88*a*, 89*a* at the connecting portion 81*b* side of the signalers 88, 89, blue LEDs 90, 90 and red LEDs 91, 91 are provided, respectively. Alternatively, on the opposite side surfaces 88*b*, 89*b* of the surfaces 88*a*, 89*a*, two blue LEDs 90, 90 and two red LEDs 91, 91 are also provided (no illustration in FIG. 10). The signalers 88, 89 lights any one of the blue LED 90 and the red LED 91 for each surface on the basis of the signal from the microcomputer stored in the drive box 84. Additionally, on the upper surface of the signaler 88, a remote control signal light receiving portion 92 for receiving a remote control signal from the transmitter 1 is disposed.

In addition to these, the switching unit 3 is provided with a battery box 93 for storing the motor in the drive box 84 and a battery as a power supply of a microcomputer or the like.

Figure 11A:
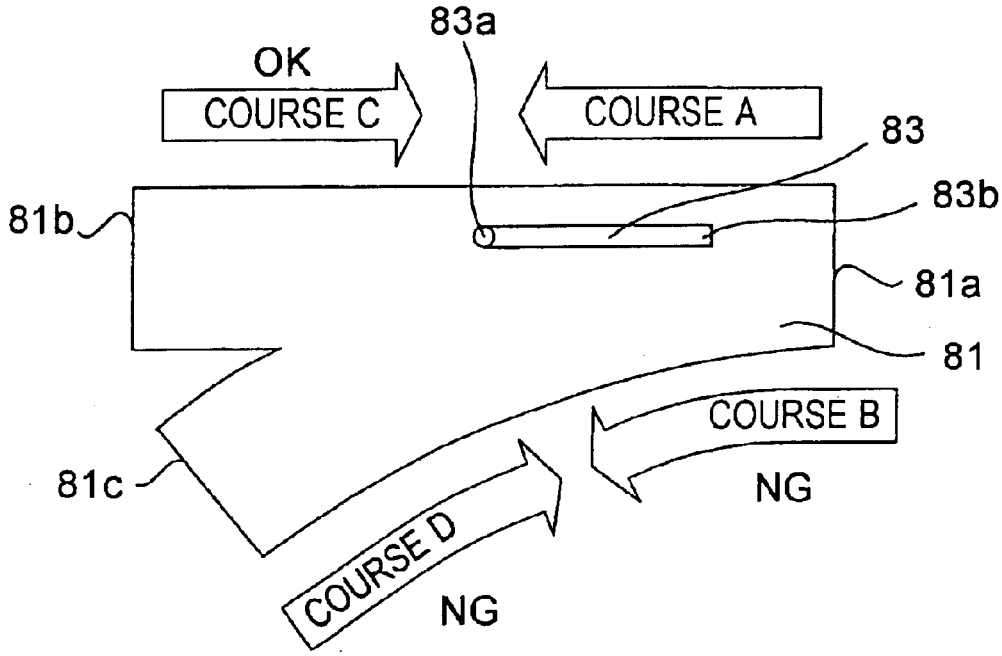
FIG. 11 is a view for illustrating a condition that a track is changed by a rudder.
Figure 11B:
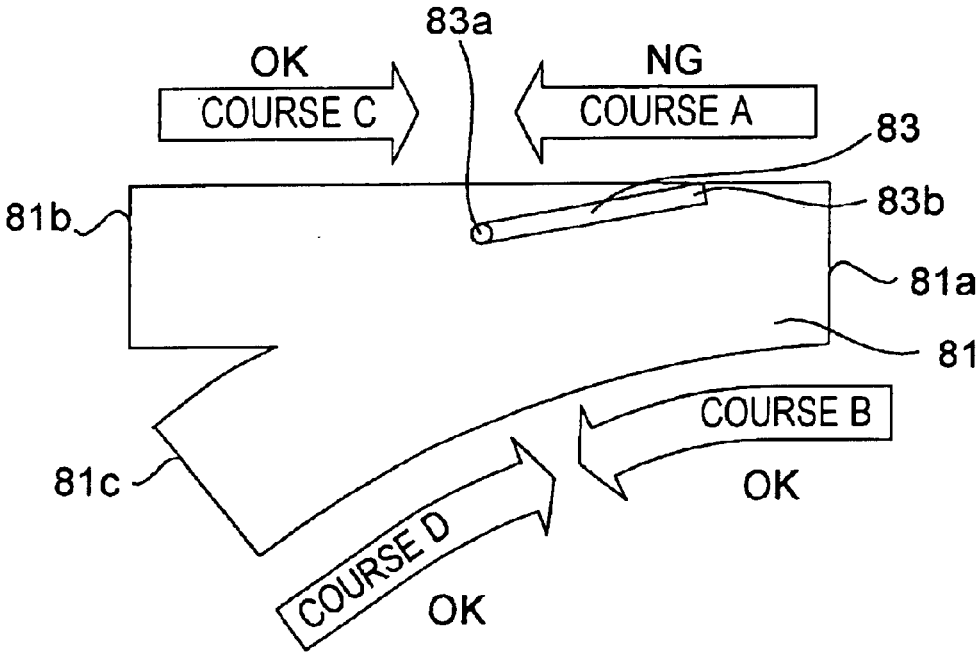

FIG. 11 is a view for illustrating a condition that a track is changed by the rudder 83. The rudder 83 is rotatably attached centering on an axial portion 83*a*, which is provided in alignment with the fallen portions 82*a* and 82*b* (see FIG. 10). In this case, as shown in FIG. 11A, in the case of the model train 50 traveling on a course A or a course C, the rudder 83 is fixed so that it is in parallel with a line to connect the connecting portions 81*a* and 81*b*, namely, so that it forms a line with the fallen portions 82*a* and 82*b*. Accordingly, the model train 50 is guided to a direction of the course A or a course C as contacting the inside of the front wheel 53 and of the rear wheel 54 and the outside of the fallen portion 82 with each other (the upper side of FIG. 11A). On the other hand, as shown in FIG. 11B, in the case of the model train 50 traveling on the course B or the course C, the condition of the rudder 83 is that, an end portion 83*b* at the opposite side of the axial portion 83*a* is moved to the outside of the track element 81. Accordingly, the model train 50 is guided to a direction of the course B or a course D as contacting the outside of the front wheel 53 and of the rear wheel 54 and the inside of the rudder 83 with each other (the lower side of FIG. 11A). Alternatively, a force holding the end portion 83*b* at the outside of the track element 81 may be set smaller so that the model train 50 traveling on the course C can go straight as pushing the rudder 83 inwardly at the inside of the front wheel 53 and of the rear wheel 54 even when the end portion 83*b* is located at the outside of the track element 81.

Figure 12:
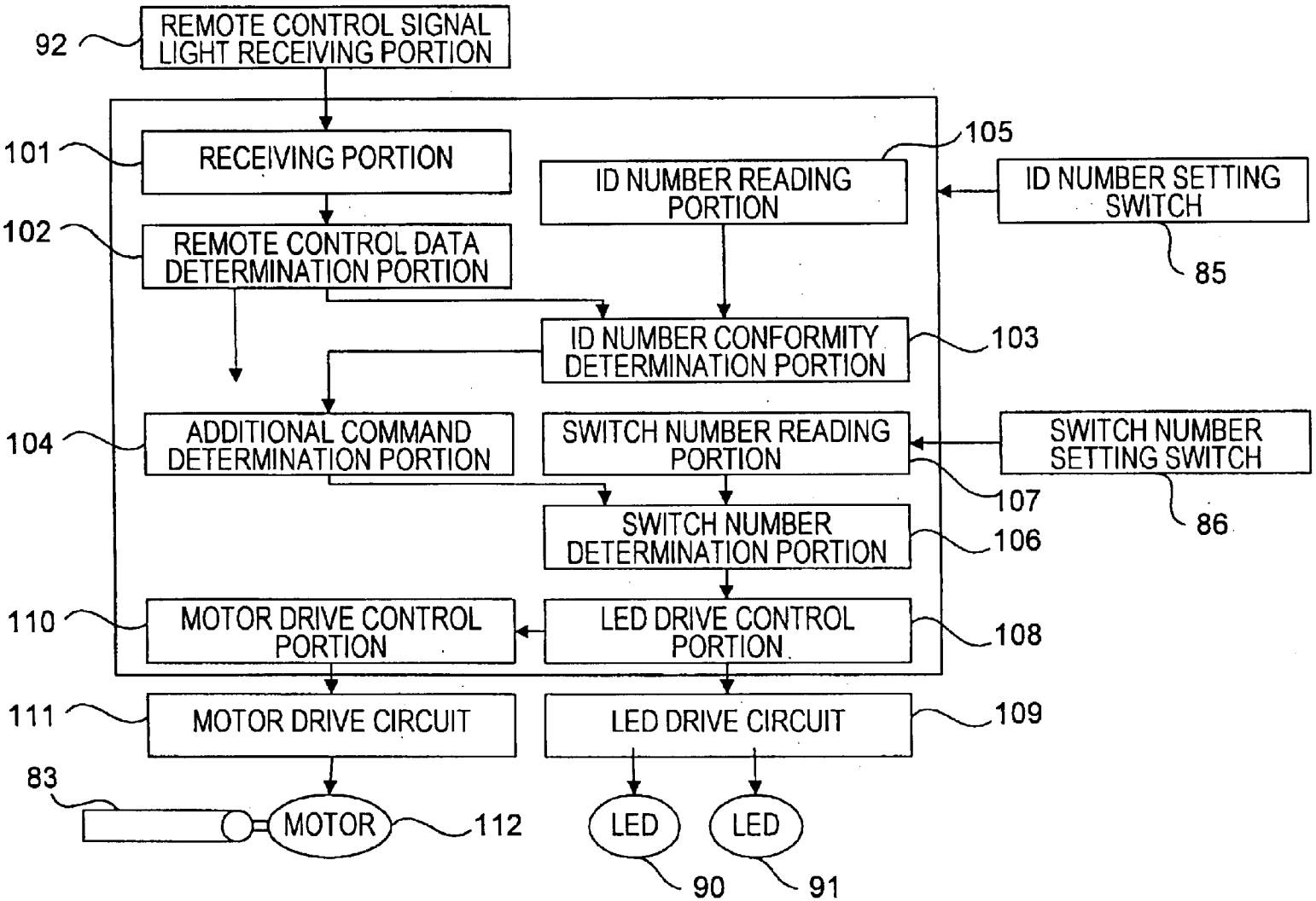
FIG. 12 is a block diagram of the switching unit shown in FIG. 10.

FIG. 12 illustrates a circuit constitution of a control system, which is installed in the switching unit 3. The switching unit 3 is provided with the above described remote control signal light receiving portion 92. The remote control signal light receiving portion 92 receives the infrared light which is transmitted from the transmitter 1 and then, it outputs a signal that a carrier component is removed from the received infrared light to a receiving portion 101. The receiving portion 101 decodes a signal that is supplied from the remote control signal light receiving portion 92 into the remote control data for one block and outputs it to a remote control data determination portion 102. The remote control data for one block is as shown in FIG. 7 and a table 1. The remote control data determination portion 102 determines the ID portion of the received data supplied from the receiving portion 101 and the portion of the additional command and outputs a signal corresponding to that ID code to an ID number conformity determination portion 103. Simultaneously, the remote control data determination portion 102 outputs a signal corresponding to a code of the additional command to an additional command determination portion 104. The ID number conformity determination portion 103 compares the ID supplied from the remote control data determination portion 102 with the ID selected by the ID code setting switch 85, which is obtained through an ID number reading portion 105, so that it determines whether these IDs are in conformity with each other or not. Then, if the ID number conformity determination portion 103 determines that they are in conformity with each other, it outputs a conformity signal to the additional command determination portion 104.

If the conformity signal is outputted from the ID number conformity determination portion 103, the additional command determination portion 104 determines whether a code of the additional command is 10abcd or 11abcd on the basis of a signal from the remote control data determination portion 102 as well as it determines a switch number which is turned on and outputs a signal corresponding to the determination result to a switch number determination portion 106. The switch number determination portion 106 compares a switch number, which is turned on and is supplied from the additional command determination portion 104, with a switch number which is selected by the switch number setting switch 86, which is obtained through a switch number reading portion 107, so that it determines whether the switching unit 3 itself is an object to be controlled or not. In the case where the switching unit 3 itself is an object to be controlled, the switch number determination portion 106 outputs a signal for instructing to change a lighting condition of the signalers 88, 89 to a LED drive control portion 108. The LED drive control portion 108 outputs a signal corresponding to that lighting condition to a motor drive control portion 110 after it outputs a signal for switching over lighting LEDs 90, 91 to a LED drive circuit 109. On the basis of a signal from the LED drive control portion 108, the LED drive circuit 109 lights or extinguishes the LEDs 90, 91. The motor drive control portion 110 determines whether the ruder 83 is needed to be switched over or not on the basis of a signal from the LED drive control portion 108. Then, in the case where the motor drive control portion 110 determines that the ruder 83 is needed to be switched over, it supplies a motor drive signal to a motor drive circuit 111. The motor drive circuit 111 drives a motor 112 as a driving source of the rudder 83 in accordance with the supplied motor drive signal.

The receiving portion 101, the remote control data determination portion 102, the ID number conformity determination portion 103, the additional command determination portion 104, the ID number reading portion 105, the switch number determination portion 106, the switch number reading portion 107, the LED drive control portion 108 and the motor drive control portion 110 may be constituted as a logic circuit or they may be constituted by the combination of the microcomputer and a predetermined program.

Figure 13:
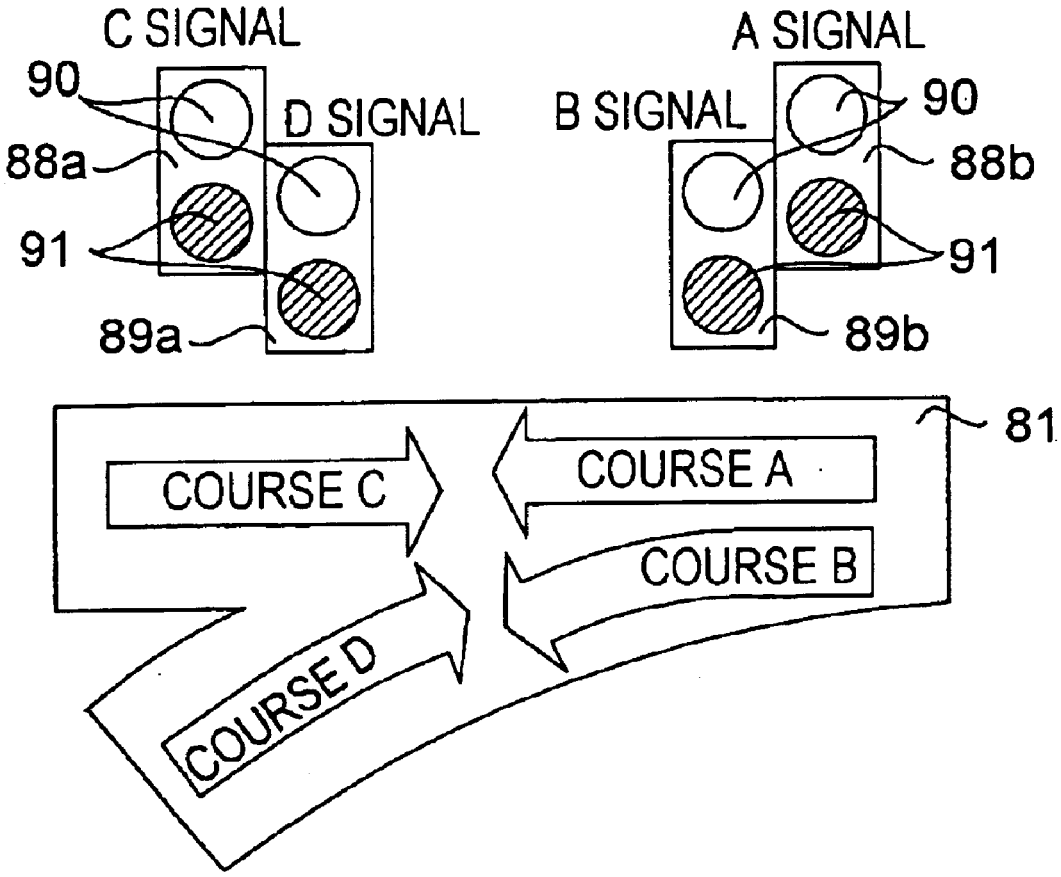
FIG. 13 is a view for illustrating the association of a signal and a course in the switching unit.

FIG. 13 and FIG. 14 illustrate the association of a signal and a course in the switching unit 3. As shown in FIG. 13, four signals A to D are provided in association with four courses A to D, respectively. Alternatively, as shown in FIG. 14, only a signal corresponding to one course which is determined to enable the model train to travel on in four courses lights the blue LED 90 and other signals light the red LED 91. For example, in the case where the course A is determined to enable the model train to travel on, the signal A lights the blue LED 90 as well as it extinguishes the red LED 91 and the signals B, C and D extinguish the blue LED as well as light the red LED 91. In the transmitter 1, in which the same ID as the one set in the switching unit 81 is set, the courses, which are determined to enable the model train to travel on, are switched over one by one in the order of the course A, B, D and C each time when the number selecting switch 30 corresponding to the switch number, which is set in the switching unit 81, is turned on once. Alternatively, a position of the rudder 83 may be changed over according to need accompanied by the change of a course, on which the model train is capable of traveling, is changed over. For example, in the case where the model train is capable of traveling on the course A, the signal A is lighting the blue LED 90 and the rudder 83 is located on a position shown in FIG. 11A. In this case, if the number selecting switches 30 are turned on once, the signal A extinguishes the blue LED 90 and lights the red LED 91 and the signal B lights the blue LED 90 and extinguishes the red LED 91. Alternatively, the position of the rudder 83 is changed to a position shown in FIG. 11B. In other words, the course B is defined as a course, on which the model train is capable of traveling. Further, if the number selecting switches 30 are turned on once, the signal B extinguishes the blue LED 90 and lights the red LED 91 and the signal D lights the blue LED 90 and extinguishes the red LED 91. However, the rudder 83 remains on a position shown in FIG. 11B. In other words, the course D is defined as a course, on which the model train is capable of traveling.

Figure 15:
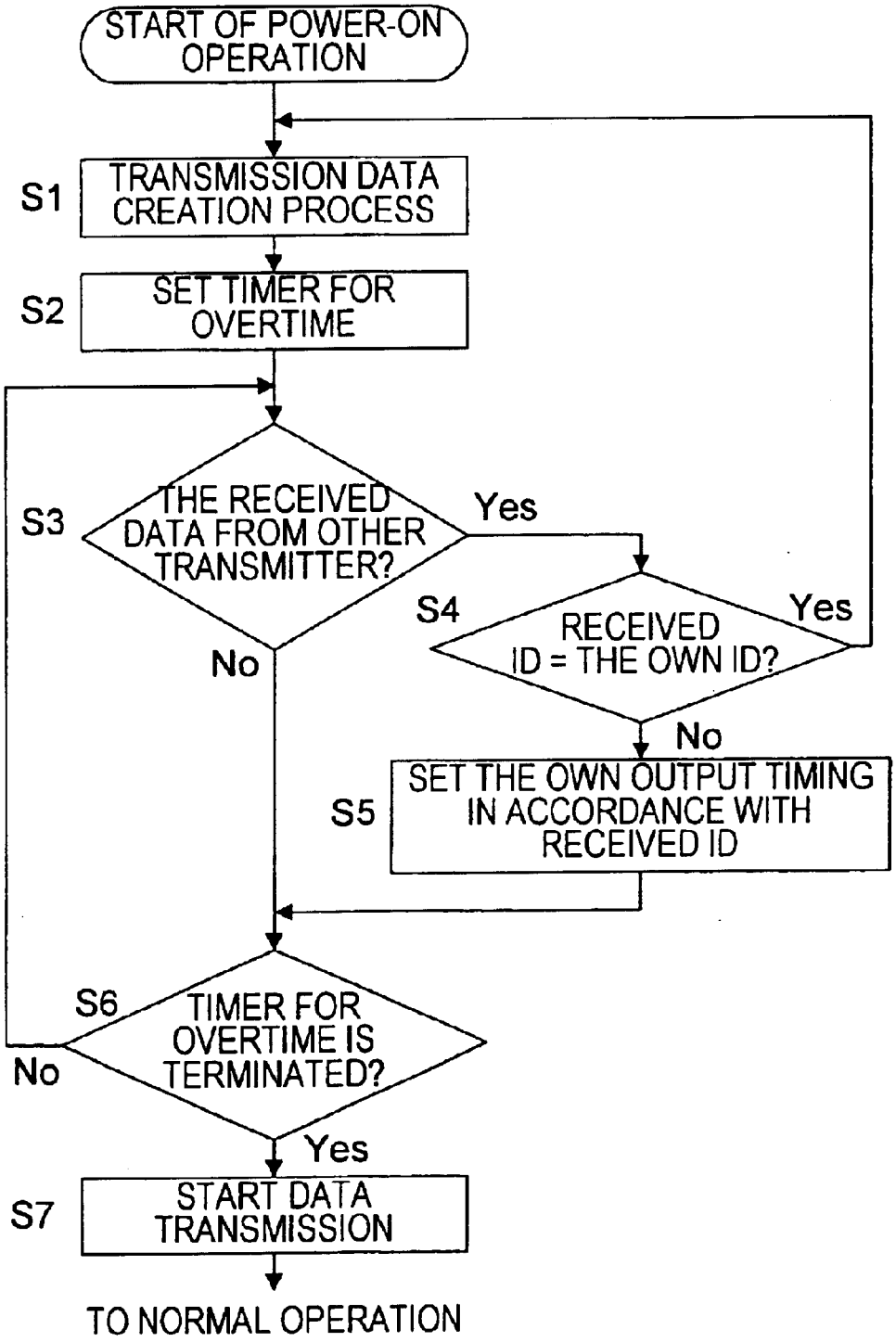
FIG. 15 is a flow chart for showing a procedure of the power-on operation to be carried out by the transmitter shown in FIG. 2 from a power supply is turned on until the transmitter starts the transmission of the data of itself.

FIG. 15 is a flow chart for showing a procedure of the power-on operation to be carried out by the transmitter 1 from a power supply is turned on until the transmitter 1 starts the transmission of the data of itself. If the power supply is turned on, at first, the transmitter 1 carries out the transmission data creation process (step S1). The transmission data creation process will be described later. In step S2, a timer for overtime is set. Then, the transmitter 1 determines whether it receives the data from other transmitter 1 or not (step S3). If it is determined that the transmitter 1 receives the data, the transmitter 1 determines whether the ID of the received data is identical with the ID which is set with respect to the own transmitter 1 or not (step S4). If they are identical with each other, the transmitter 1 returns to the step 1 to repeat the determination operation. Hereby, it is possible to prevent the interference in the case where a plurality of transmitters 1 having the same ID exist. If it is determined that the IDs are not identical with each other in the step S4, the transmitter 1 sets a transmission timing of itself in accordance with the ID of the other transmitter 1 (step S5). For example, in the case where the transmitter 1 of ID=3 shown in FIG. 6A receives the data of ID=1, the present transmitter 1 sets the transmission timing of itself after 2×T2 time.

Subsequently, the transmitter 1 determines whether the timer, which has been set in step S2, is overtimed or not (step S6). If it is not overtimed, the transmitter 1 returns to the step S3. In the case of overtime, the transmitter 1 starts the transmission of the data (step S7). However, it starts the output in actual at a point of time when the transmission timing, which has been set in the step S5, arrives. In the case where the transmitter 1 has not receive any data by the overtime, it results in the independent operation, namely, it results in nonexistence of other transmitter 1, so that the transmitter 1 immediately starts the data transmission in step 7.

Figure 16:
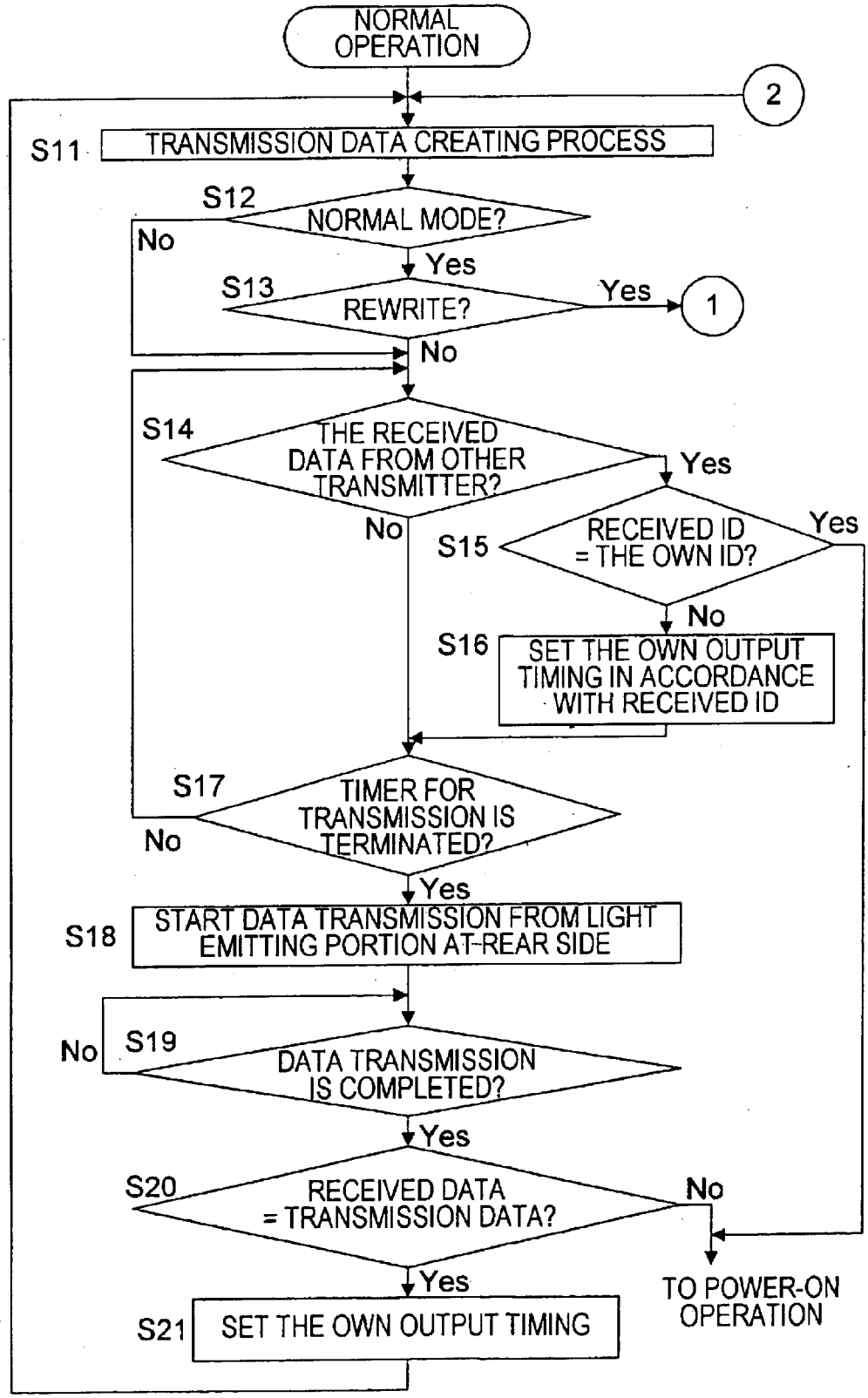
FIG. 16 is a flow chart for showing a procedure of a normal operation to be carried out by the transmitter shown in FIG. 2 following the process shown in FIG. 15.

If the process in the step S7 is completed, the transmitter 1 controls the data transmission in accordance with the procedure of the normal operation shown in FIG. 16. According to the normal operation, at first, the transmission data creating process will be performed (step S11). This transmission data creating process will be explained later. In the next place, it is determined whether the mode changing over switch 31 is located at a position of a normal mode or not (step S12). If it is determined that the mode changing over switch 31 is not located at a position of a normal mode, step S13 is skipped. If it is determined that the mode changing over switch 31 is located at a position of a normal mode, the transmitter 1 determines whether the rewriting control switch 28 is turned on or not (step S13). If the rewriting control switch 28 is not turned on, the transmitter 1 determines whether it receives the data from other transmitter 1 or not (step S14). If it is determined that the transmitter 1 receives the data, the transmitter 1 determines whether the ID of the received data is identical with the ID which is set with respect to the own transmitter 1 or not (step S15). If they are identical with each other, the transmitter 1 returns to the power-on operation shown in FIG. 15. On the other hand, If it is determined that the ID of the received data is different from the own ID, the transmitter 1 sets a transmission timing of itself in accordance with the ID of the received data on the transmission timer (step S16). In the next place, it is determined that time is up in the transmission timer or not (step S17) and the transmitter 1 returns to the step S14 unless time is up.

If it is determined that time is up in the step 17, the transmitter 1 starts the transmission of the own data from the remote control signal light emitting portion 22, which is disposed on the rear side of the transmitter 1 (step S18). In this time, the data is received concurrently. In the next place, it is determined whether the data transmission has been completed or not (step S19). If the transmission has been completed, the transmitter 1 compares the transmitted data with the data, which is received concurrently with this transmission (step S20). If they are not identical with each other, it is determined that the interference is generated and the transmitter 1 proceeds the power-on operation shown in FIG. 15. If they are identical with each other, it is possible to assume that there is no interference, so that the transmitter 1 sets a next transmission timing on the transmission timer (step S21). Then, the transmitter 1 returns to the step S11.

Figure 6B:
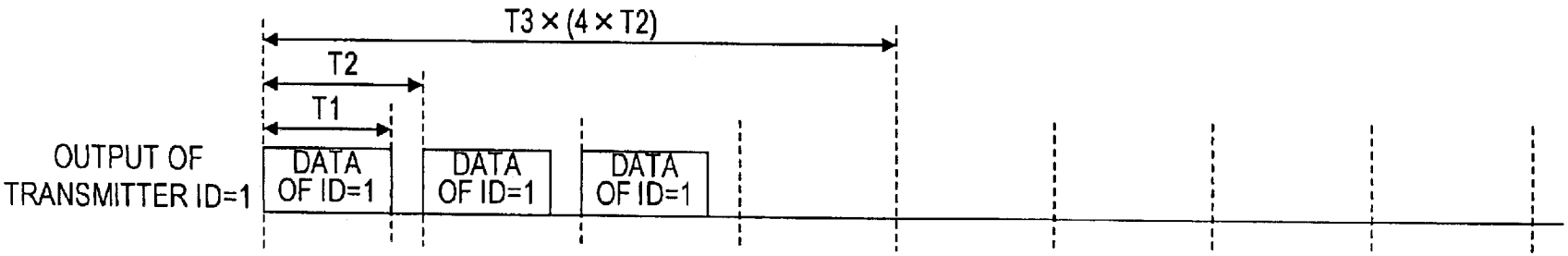
Figure 17:
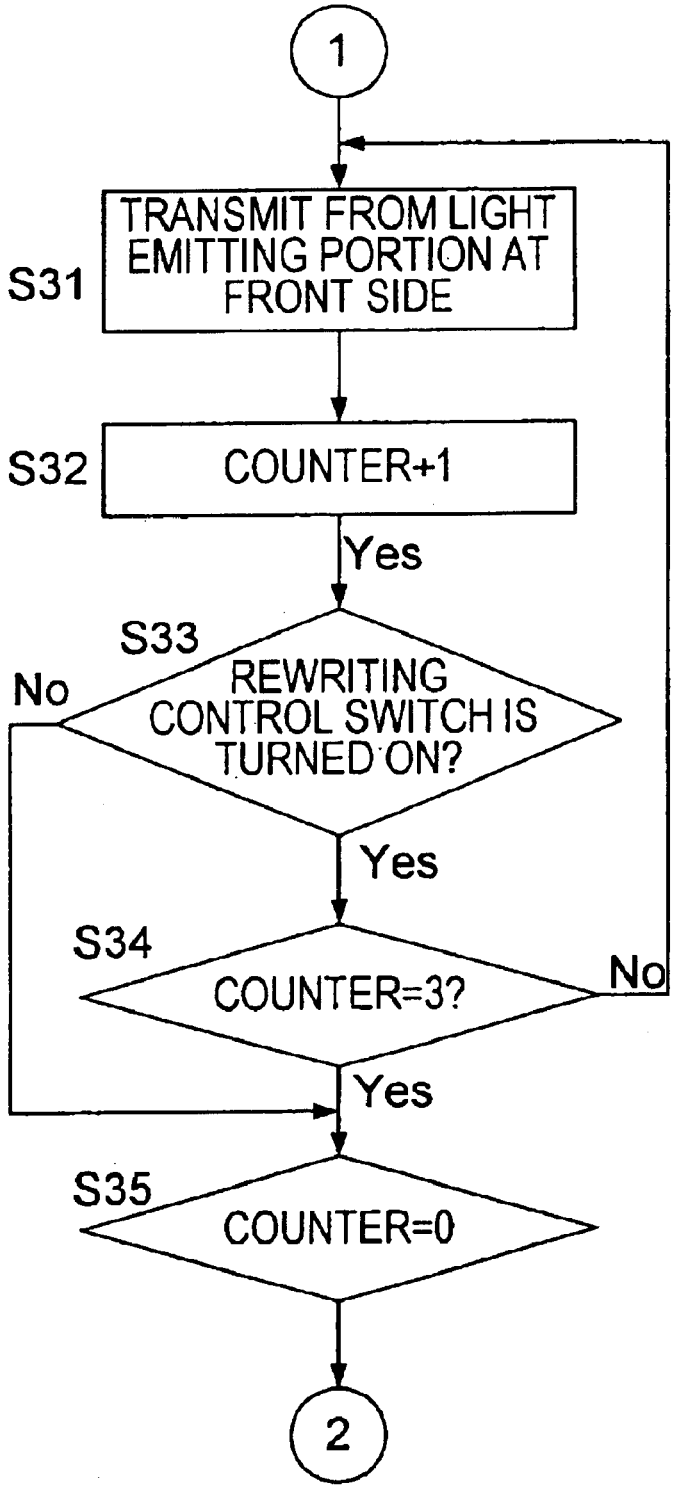
FIG. 17 is a flow chart for showing a procedure of a normal operation to be carried out by the transmitter shown in FIG. 2 following the process shown in FIG. 15.

In the case where it is determined that the rewriting control switch 28 is turned on in the step S13, as shown in FIG. 17, the transmitter 1 transmits the data. In other words, after the step S13, the transmitter 1 immediately transmits the data from the remote control signal light emitting portion 23, which is disposed on the front side of the transmitter 1 (step S31). Subsequently, the transmitter 1 adds "1" to a counter as a parameter for counting the number of the continuous transmission of the data for instructing the rewriting (step S32). After that, it is determined whether the rewriting control switch 28 has been continuously turned on or not (step S33). If it is determined that the rewriting control switch 28 has been continuously turned on, the transmitter 1 determines whether a counter value of the counter attains "3" or not (step S34). If the counter value is less than 3, the transmitter 1 returns to the step S31 to transmit the data again. If it is determined that the rewriting control switch 28 is turned off in the step S33 or it is determined that the counter value of the counter attains "3", the transmitter 1 completes the process shown in FIG. 17. According to the process shown in FIG. 17, if the user continues to push the rewriting control switch 28, as shown in FIG. 6B, three frames are continuously transmitted from the remote control signal light emitting portion 23, each of which has the data for instructing the rewriting of the identification information.

Figure 18:
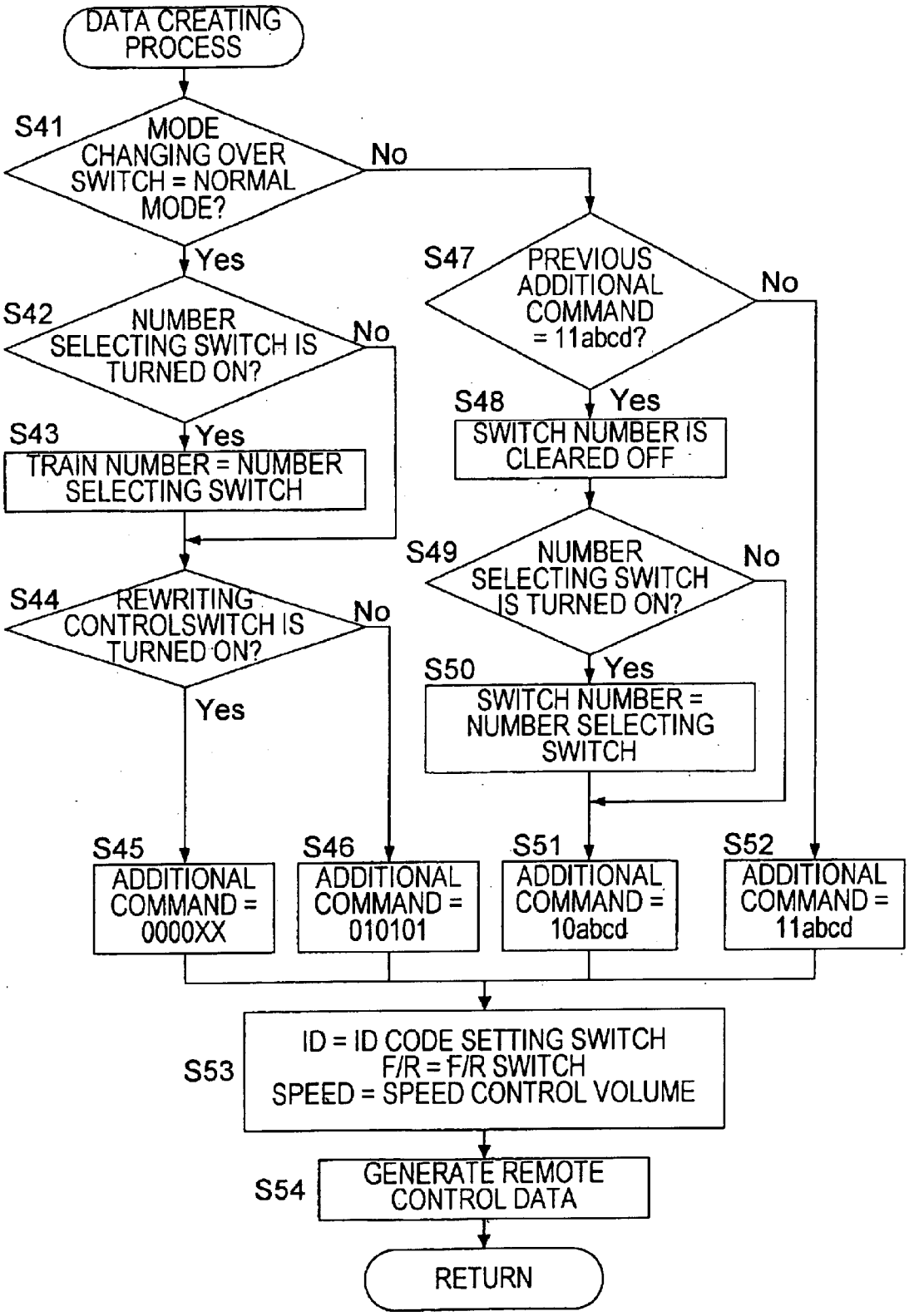
FIG. 18 is a flow chart for showing a procedure of a transmission data creating process to be carried out by a microcomputer of the transmitter shown in FIG. 2 during the process shown in FIG. 15 and FIG. 16.

FIG. 18 is a flow chart for showing a procedure of a transmission data creating process to be carried out by the transmitter 1 in the step S1 shown in FIG. 15 and the step S11 shown in FIG. 16. Firstly, it is determined whether a normal mode is selected or not by the mode changing over switch 31 or not (step S41). In the case where the normal mode is selected, it is determined whether the pushing operation is performed or not in any of the number selecting switches 30 . . . 30(step S42). In the case where it is determined that the pushing operation is performed, a number corresponding to this number selecting switch 30 is set in a train number as a parameter held by the transmitter 1 (step S43). In the case where it is determined that the pushing operation is not performed, step S43 is skipped. In the next place, it is determined whether the rewriting control switch 28 is turned on or not (step S44). If it is not turned on, 0000xx is set in the additional command as a parameter held by the transmitter 1 (step S45). If it is turned on, 010101 is set in the additional command as a parameter held by the transmitter 1 (step S46).

In the step S41, in the case where it is determined that the mode is not normal mode, it is determined whether 11abcd is set or not in the additional command as a parameter, namely, it is determined whet her the previous additional command is 11abcd or not (step S47). In the case where it is determined the previous additional command is 11abcd, a switch number as a parameter held by the transmitter 1 is cleared off (step S48). In the next place, it is determined whether the pushing operation is performed or not in any of the number selecting switches 30 . . . 30 (step S49). If it is determined that the pushing operation is performed, a number corresponding to this number selecting switch 30 is set in a switch number as a parameter (step S50). In the case where it is determined that the pushing operation is not performed, step S50 is skipped. In the next place, 10abcd is set in the additional command as a parameter. In this case, in the code of abcd, a bit corresponding to the switch number set in the step S50 is turned on and other bits are turned off. In the case where it is determined that the previous additional command is not 11abce in the step S47, 11abcd is set in the additional command (step S52).

In step S53, the values corresponding to the ID code setting switch 29, the F/R switch 26 and the speed control volume 27 are set in the ID, the F/R and the speed as a parameter held by the transmitter 1. Then, in step S54, on the basis of the parameter held by the transmitter 1, the remote control data is generated.

According to the above described process, the train number of the remote control data is changed only when the number selecting switch 30 is pushed in the case where a normal mode is selected in the mode changing over switch 31. In the case where the mode changing over switch 31 is switched over to the switch control mode, a train number selected at the last is held. Alternatively, a code of the additional command for controlling the switching unit 3 is set only when the switch control mode is selected in the mode changing over switch 31, so that the remote control data including the code of 10abcd and the remote control data including the code of 11abcd are alternately generated and transmitted. On the other hand, The ID and the motor control information of the remote control data are set to the information corresponding to the ID code setting switch 29, the F/R switch 26 and the speed control volume 27 even when the mode changing over switch 31 is in any mode of a normal mode and a switch control mode.

Figure 19:
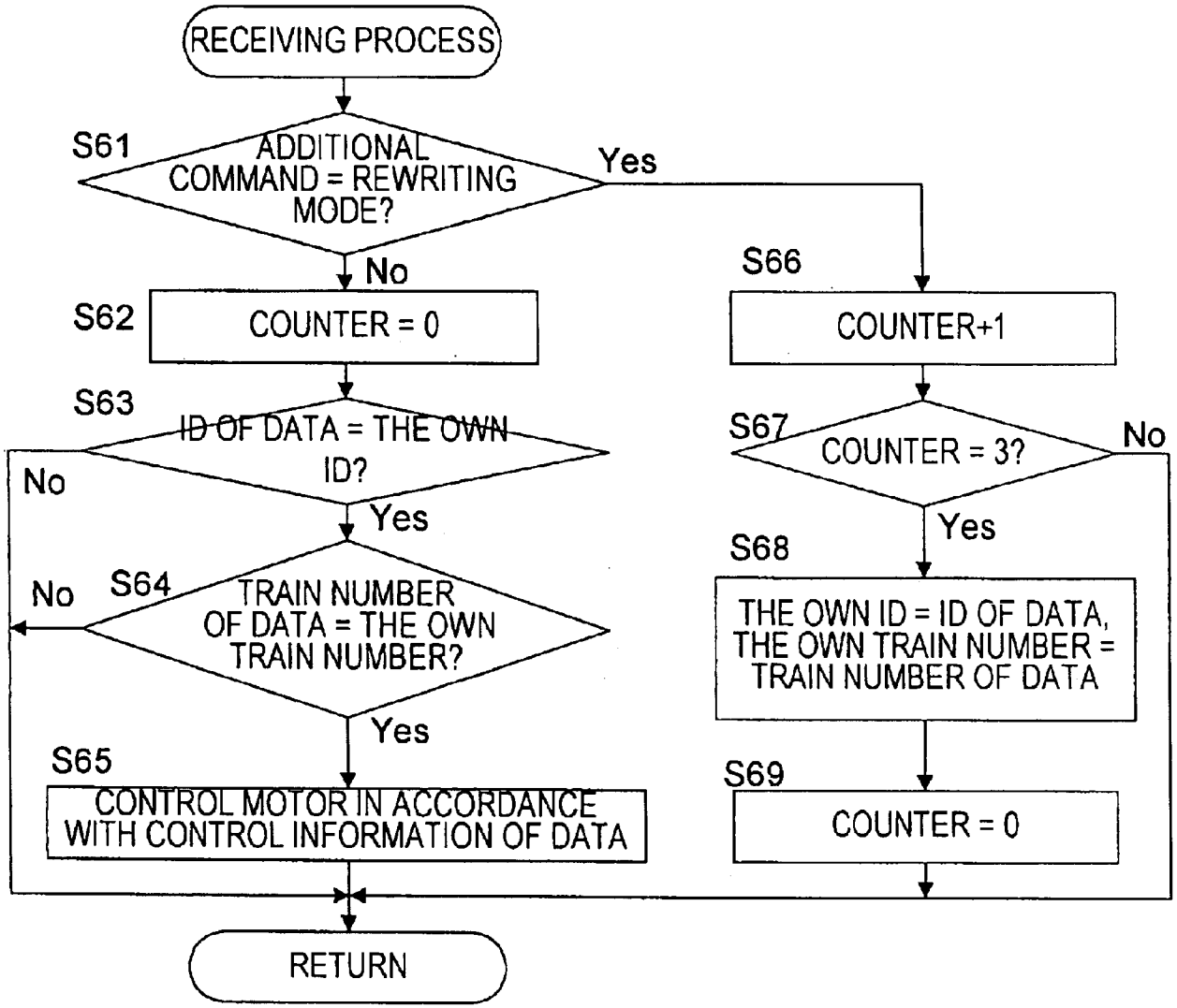
FIG. 19 is a flow chart for showing a procedure of a receiving process to be carried out by a control device of the model train shown in FIG. 8.

FIG. 19 is a flow chart for showing a receiving process to be carried out by a control device 59 of the model train 50 when it receives the data from the transmitter 1. The control device 59 determines whether a command of the additional code included in the received data is 010101 or not, namely, the received data serves as the data to rewrite the identification information or the data to control the operation of the motor 58 (step S61).

In the case where the received data is determined as the data for controlling the operation of the motor 58, a counter is set in 0 (step S62). In the next place, it is determined whether the ID code included in this data is identical with the own ID code or not, which is recorded in the identification information storing memory 78 (step S63). In the case where the ID code included in this data is different from the own ID code, ignoring this data, the process shown in FIG. 19 is terminated once. In this case, the control device 59 awaits the next data reception. In the case where it is identical with the own ID code, it is determined whether the train number included in the data is identical with the own train number, which is stored in the identification information storing memory 78, or not (step S64). In the case where it is different from the own train number, ignoring this data, the control device 59 awaits the next data reception. In the case where it is identical with the own train number, the motor 58 is controlled in accordance with the control information, which is included in this data (step S65), and then, the control device 59 awaits the next data reception.

In the step S61, if it is determined that the received data is the data for rewriting the identification information, "1" is added to the counter (step S66) and it is determined whether the counter value attaints 3 or not (step S67) and the data for rewriting the identification information are continuously received three times or not (step S67). In the case where the counter value does not attain 3, the control device 59 awaits the next remote control data reception. In the case where the counter value attains 3, the ID code and the train number, which are recorded in the identification information storing memory 78, are rewritten into the ID code and the train number included in the data, which is received at this time (step S68). After that, the counter is reset to 0 (step S69) to await the next data reception.

According to the above described process, when the train model 50 as a drive unit continuously receives the remote control data, in which the code of the additional command is 010101, three times, the ID code and the train number are changed. In other cases, only when the ID code and the train number, which are included in the data, are identical with the own the ID data and the train number respectively, the operation of the motor 58 is controlled in accordance with the motor control information.

According to the above described embodiment, the ID code and the train number are changed all at once. However, by preparing a code of the additional command to change the ID code and a code of the additional command to change the train number, the ID code and the train number may be changed separately. Comparing the ID code of the received data to the ID code set in the drive unit (step S63) previous to the judgement of a command (step S61), the train number may be changed only with respect to the drive unit in which the same ID code is set as in the transmitter. Alternatively, it is above described about one example that the instruction data to change the identification information are continuously received three times is cited. However, the instruction data may be received once or not less than three times.

Figure 20:
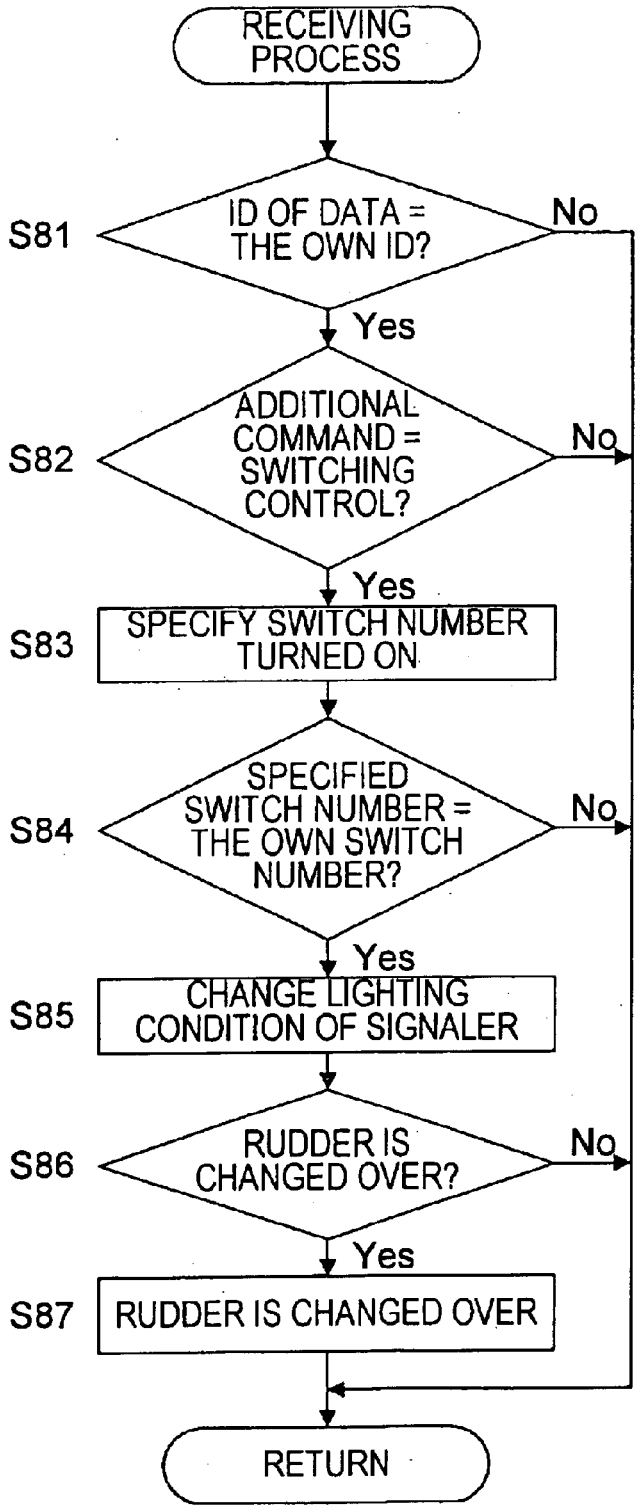
FIG. 20 is a flow chart for showing a receiving procedure to be carried out by the switching unit shown in FIG. 10.

FIG. 20 is a flow chart for showing a receiving procedure to be carried out when the switching unit 3 receives the data from the transmitter 1. Firstly, the switching unit 3 determines whether the ID of the received data is identical with the own ID which is selected by the ID number setting switch or not, namely, it determines whether the received data is the transmission data from the transmitter 1 corresponding to itself or not. In the case where the switching unit 3 determines that the received data is not the transmission data from the transmitter 1 corresponding to itself, it terminates the process and awaits the next data reception. In the case where the switching unit 3 determines that the received data is the transmission data from the transmitter 1 corresponding to itself, it determines whether the code of the additional command is 10abcd or 11abcd, namely, it determines whether the code of the additional command is the control information of the switching unit 3 or not (step S82). In the case where the switching unit 3 determines that the code of the additional command is not the control information for itself, it terminates the process and awaits the next data reception. In the case where the switching unit 3 determines that the code of the additional command is the control information for itself, it specifies the switch number corresponding to a bit that is turned on in the code of abcd (step S83). Next, it determines whether the specified switch number is identical with the own switch number or not (step S84). In the case where it determines that the specified switch number is not identical with the own switch number, it terminates the process and awaits the next data reception. In the case where it determines that the specified switch number is identical with the own switch number, it lights or extinguishes the blue LED 90 and the red LED 91 to change over the signaler (step S85). Then, it determines whether the position of the rudder 83 should be changed over or not (step S86). In the case where it determines that the position of the rudder 83 should be changed, the transmitter 1 changes over the position of the rudder 83 (step S87) and in the case where it determines that the position of the rudder 83 should not be changed, it skips step S87 to terminate the process.

Alternatively, the step S82 may precede the step S81. Additionally, since the remote control data, of which code of the additional command is 10abcd, and the remote control data, of which code of the additional command is 11abcd, are alternately transmitted (see FIG. 18), determining whether the present remote control data includes a bit corresponding to the own switch number or not after the step S82, the switching unit 3 may sort out the remote control data.

According to the above described embodiment, the remote control data, in which only one bit among the bits corresponding to the switch numbers of 1 to 8 is turned on, is explained as an example. However, not less than two bits may be turned on and not less than two switching units may be simultaneously controlled. The remote control data, in which one bit of the additional command code corresponds to one of the switch numbers, is explained as an example. However, the switch number may be identified by the least bits, for example, the switch numbers of 1 to 8 are distinguished by the information of three bits. Further, the remote control system for transmitting the control information corresponding to the switch numbers of 1 to 8 as divided into two, namely, the remote control data including the control information corresponding to the switch numbers 1 to 4 and the remote control data including the control information corresponding to the switch numbers 5 to 8 is explained as an example. However, the control information may be transmitted once or three times and over dividedly. The transmitter for transmitting the remote control data including a code of the additional command, which rewrites the identification information if the rewriting control switch 28 is pushed in the case where a normal mode is selected in the mode changing over switch 31, is explained as an example. However, the remote control data including a code of the additional command, which rewrites the identification information even if the rewriting control switch 28 is pushed in the case where a switch control mode is selected in the mode changing over switch 31, may be transmitted. In this case, the train number just before the mode is changed into the switch control mode, held by the transmitter 1, may be included in the remote control data and may be rewritten.

FIGS. 21 to 24 illustrate an operational condition in the case where there are one transmitter 1, tow drive units 2 and four switching units 3. In this case, in a transmitter A, drive units A, B, and switching units A to D, the same IDs are set, respectively. Alternatively, in the drive units A and B, the train numbers 3 and 2 are set, respectively. In the switching units A to D, the switch numbers 1, 2, 5 and 7 are set, respectively.

Figure 21:
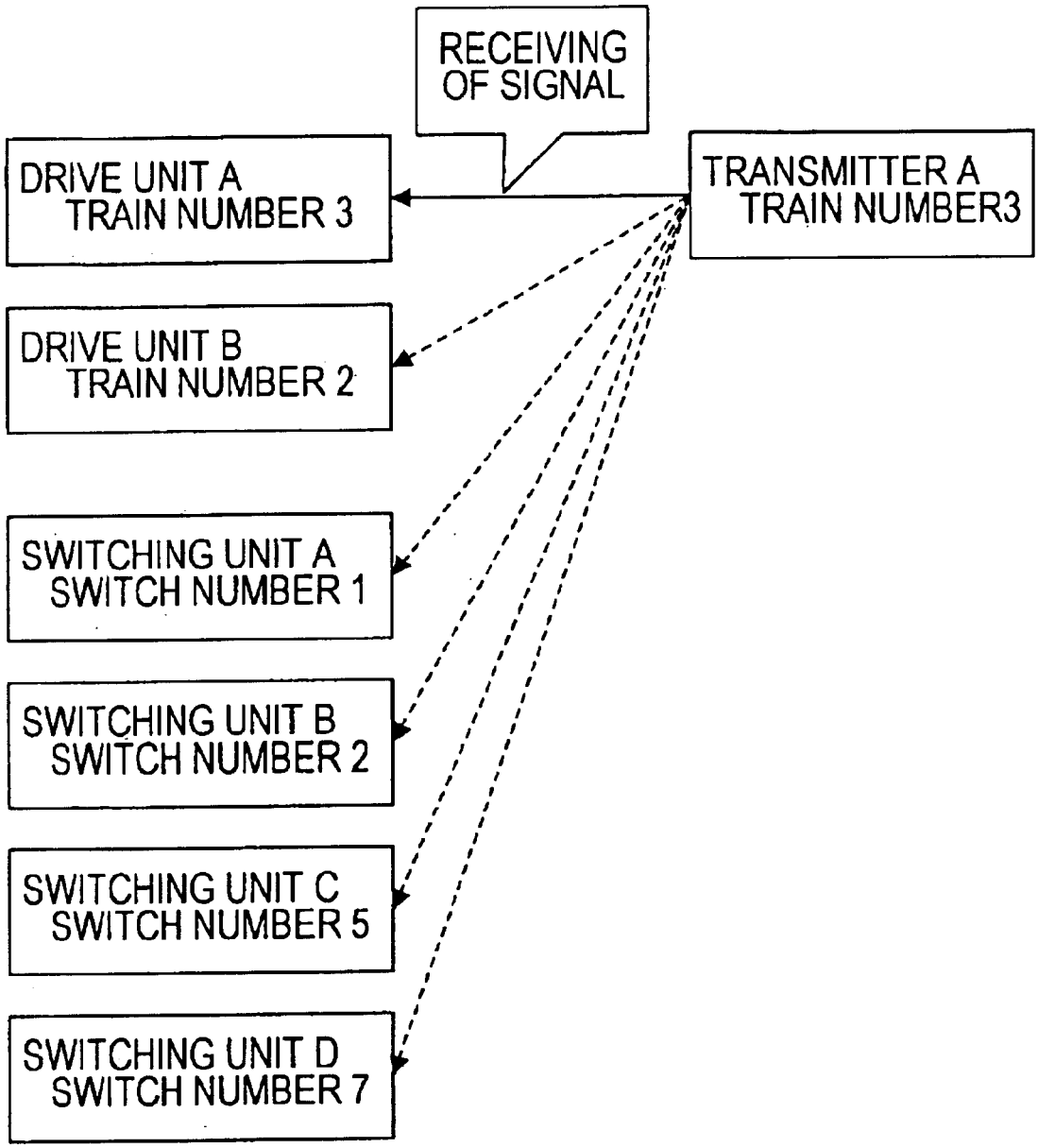
FIG. 21 is a view for illustrating an operational example of the remote control system according to the present invention.

FIG. 21 shows a condition that the train number of the transmitter A is set in 3 and the mode changing over switch 31 is set in a normal mode. As shown in FIG. 21, the transmitter A is only capable of controlling only the drive unit A, of which train number is the same as the train number thereof.

Figure 22:
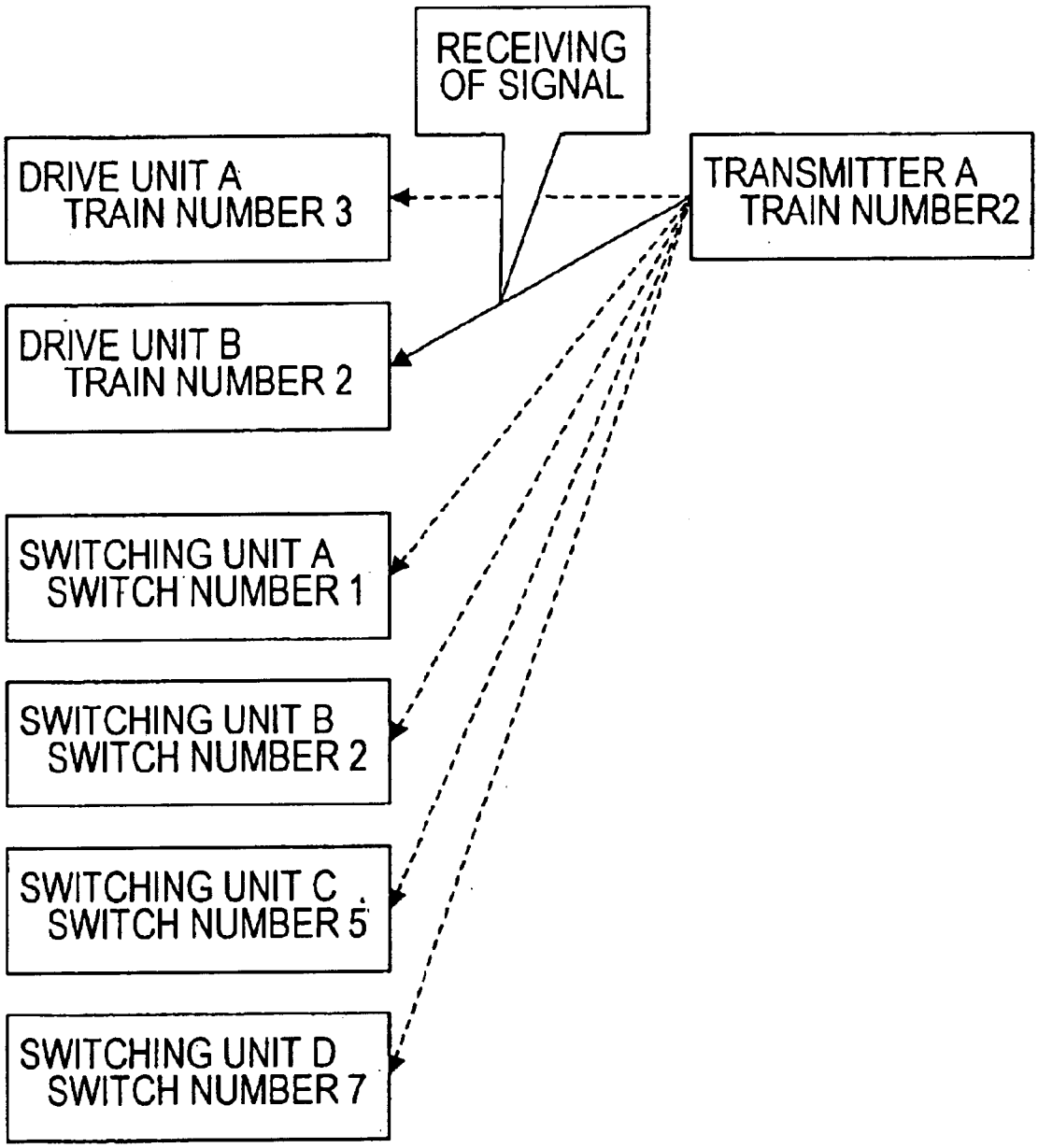
FIG. 22 is a view for illustrating an operational example of the remote control system according to the present invention.

FIG. 22 shows a condition that the train number of the transmitter A is changed from 3 to 2 in the condition shown in FIG. 21. As shown in FIG. 22, the transmitter A is capable of controlling the drive unit B.

Figure 23:
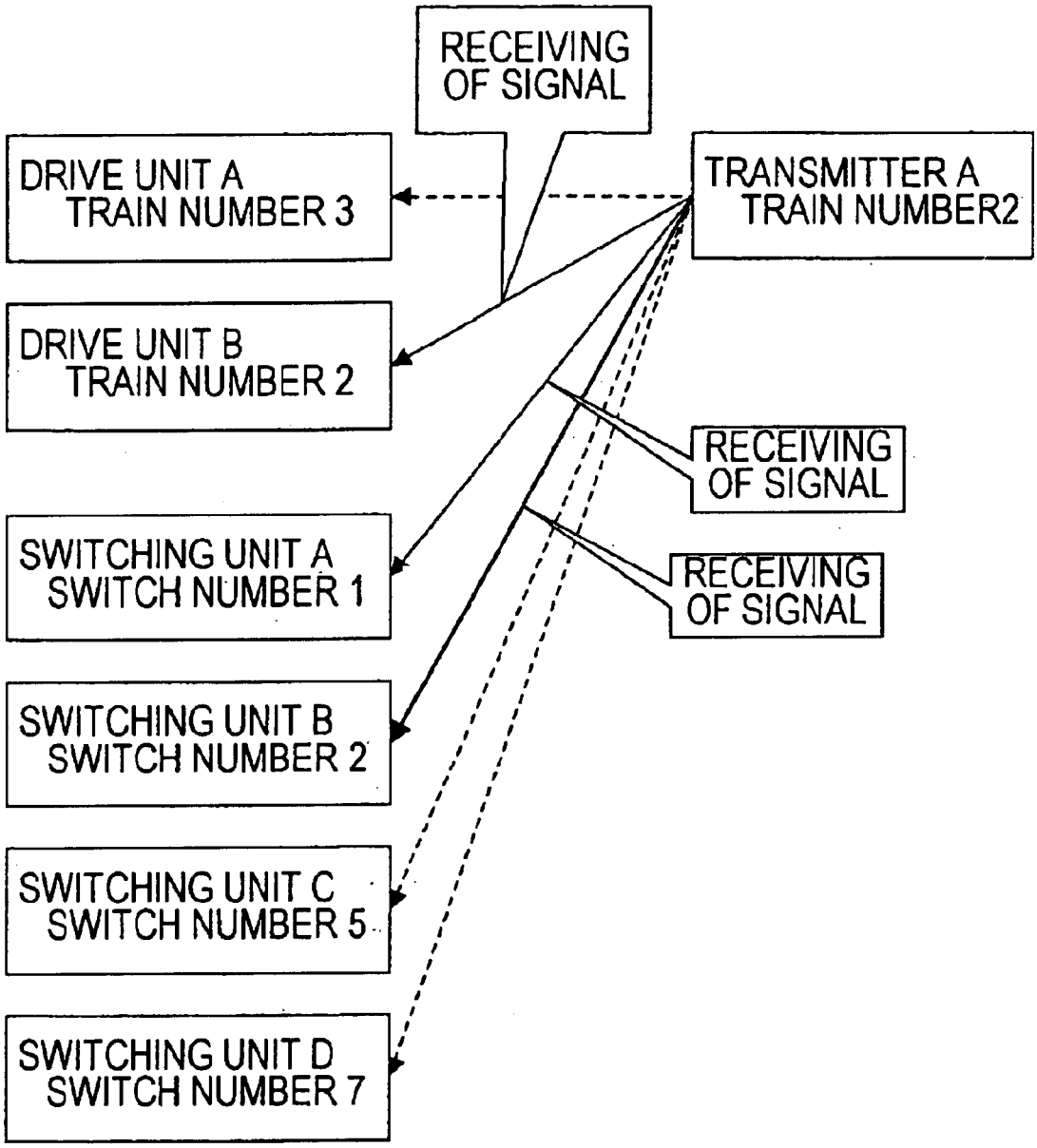
FIG. 23 is a view for illustrating an operational example of the remote control system according to the present invention.

FIG. 23 shows a condition that the mode changing over switch 31 of the transmitter A is changed into the switch control mode in the condition shown in FIG. 22. As shown in FIG. 23, the train number of the transmitter A remains "2" and it is capable of controlling the drive unit B. Alternatively, FIG. 23 shows a condition that the remote control data including the codes of the additional command corresponding to the switch numbers 1 to 4 is transmitted. By this remote control data, it is possible to control the switching unit A or the switching unit B.

Figure 24:
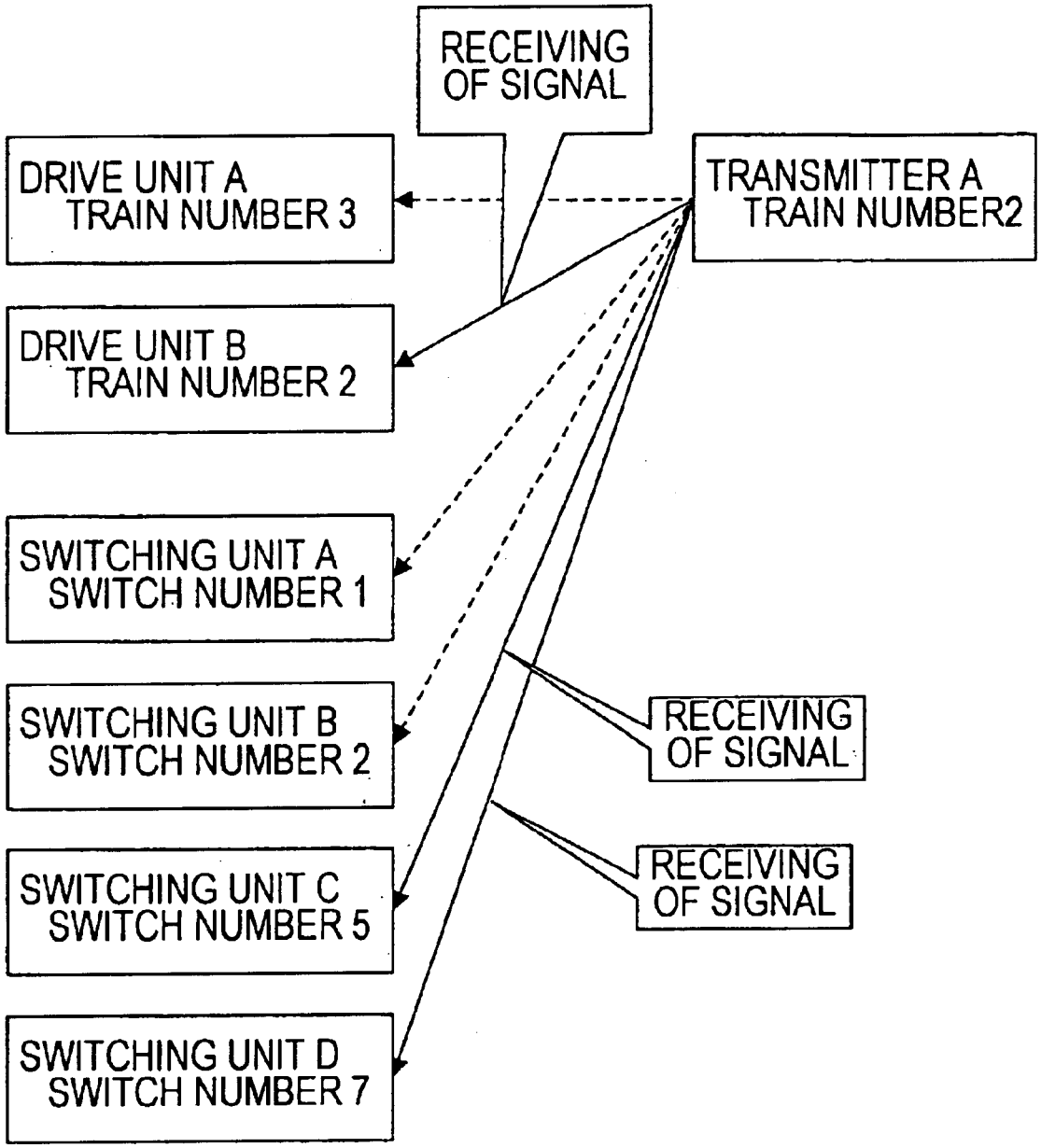
FIG. 24 is a view for illustrating an operational example of the remote control system according to the present invention.

FIG. 24 shows a condition in a frame following the frame in which the remote control data in FIG. 23 is transmitted. As shown in FIG. 24, the remote control data including the codes of the additional command corresponding to the switch numbers 5 to 8 is transmitted. By this remote control data, it is possible to control the switching unit C or the switching unit D.

A summary of the present invention is shown in a table 2.

[Table 2]

In this table, a normal mode is a case where the normal mode is selected in the mode changing over switch 31 and the rewriting control switch 28 is not pushed. In this case, a condition of the F/R switch 26 and the speed control volume 27 (mascon) are reflected on the motor control information in the remote control data of the transmitter 1. The train number can be switched over in the number selecting switch 30. As shown in (A) of the table 1, the code of the additional command is 0000xx. In the case where the drive unit 2 receives this remote control data, only when the ID and the train number included in the remote control data are identical with the own them, the drive unit 2 controls a motor on the basis of the motor control information which is included in this remote control data. In the case where the switching unit 3 receives this remote control data, it determines that the control information with respect to itself is not included and holds the previous condition.

In this table, an ID rewriting mode is a case where the normal mode is selected in the mode changing over switch 31 and the rewriting control switch 28 is pushed. In this case, the motor control information in the remote control data of the transmitter 1 is the same as that of the normal mode in this table. A train number is defined as the train number, which is selected in the mode changing over switch 31. When the identification information can be rewritten even in the case where the switch control mode is selected in the mode changing over switch 31, a train number is defined as the train number, just before the mode is switched into the switch control mode, which is held by the transmitter 1. A code of the additional command is 010101 as shown in (B)

of the table 1. In the case where the drive unit 2 receives this remote control data, the ID and the train number, which are included in the remote control data, are defined as the own ID and the own train number. In the case where the switching unit 3 receives this remote control data, the switching unit 3 determines that the control information with respect to itself is not included, so that it holds the previous condition.

In this table, a switch control mode is a case where the switch control mode is selected in the mode changing over switch 31. In this case, the motor control information in the remote control data of the transmitter 1 is the same as the one in the normal mode of this table. A train number is defined as the train number, just before the mode is switched into the switch control mode, which is held by the transmitter 1. The codes of the additional command are 10abcd and 11abcd as shown in (C) and (D) of the table 1. In the case where the drive unit 2 receives this remote control data, each of the condition is the same as the one in the normal mode in this table. In the case where the switching unit 3 receives this remote control data, the switching unit 3 determines whether the ID of the data is identical with the own ID or not. Then, if it is identical with the own ID, the switching unit 3 performs the control on the basis of the additional command.

cellular phone or the like, the portable appliance may be used as a transmitter. A switching unit is not limited to one for switching a signaler and a course and it may be a peripheral unit used with a drive unit and an external device that is separately located independently from the drive unit. A peripheral unit to be controlled by the additional command is not limited to one which is located at the outside of the drive unit and it may be an internal device, which is built in the drive unit.

According to the remote control system of the present invention, the data repeatedly transmitted from the transmitter are received in the both of the drive unit and the peripheral unit. Then, the first control information included in this data is used by the drive unit as well as the second control information is used by the peripheral unit. Accordingly, in the case where it is necessary for the drive unit to be continuously controlled, it is possible to control the peripheral unit without interrupting the control of the drive unit.

TABLE 1

| Code | Additional command | Content | Remark |
|---|---|---|---|
| (A) | 0000xx | Normal operation | Option port is set by code of xx |
| (B) | 010101 | Rewriting of ID and train number | Rewrite if this code continues for three frames.<br>Drive unit is selected depending on ID and train number which are received by the frame |
| (C) | 10abcd | Switching unit control data of switch numbers 1 to 4 (normal operation) | Condition of switching unit (On/Off) is controlled by each bit<br>a: condition of switching unit of switch number 1<br>b: condition of switching unit of switch number 2<br>c: condition of switching unit of switch number 3<br>d: condition of switching unit of switch number 4 |
| (D) | 11abcd | Switching unit control data of switch numbers 5 to 8 (normal operation) | Condition of switching unit (On/Off) is controlled by each bit<br>a: condition of switching unit of switch number 5<br>b: condition of switching unit of switch number 6<br>c: condition of switching unit of switch number 7<br>d: condition of switching unit of switch number 8 |

TABLE 2

| | Remote control data of transmitter | | | | |
|---|---|---|---|---|---|
| Mode | motor control | Train number | additional command | operation of drive unit | operation of switch unit |
| Normal mode | condition of mascon | switch over by key | data of (A) | operate by mascon data if ID and train number are identical with the own them | Invalid, hold previous condition |
| ID rewriting mode | condition of mascon | hold condition before ID rewriting mode | data of (B) | rewrite the own ID and train number by ID and train number | invalid, hold previous condition |
| Switch control mode | condition of mascon | hold condition before switch mode | transmit data of (C), (D) for each frame | operate by mascon data if ID and train number are identical with the own them. | if ID are identical with the own one, the operation controlled depending on condition of bit of additional command corresponding to the own switch number |

The present invention is not limited to the above described embodiment and it may be performed in various embodiments. For example, a drive unit is not limited to the train and models of various dynamic bodies may be available. A transmitter can be held by the operator's hands or may be fixed. Further, installing a specific program in a portable appliance such as a portable game machine and a

What is claimed is:

1. A remote control system for operating a drive unit and a peripheral unit to be used together with the drive unit, which are included in a receiving side group, by remote control with data which are repeatedly transmitted from a transmitter;

wherein the data transmitted repeatedly includes an area for setting a first control information in association with an operational condition of a user with regard to a specific operation of the drive unit and another area for setting a second control information for controlling a specific operation of the peripheral unit;

the transmitter comprises:

a data generating device for generating the data repeatedly so that the data always includes the first control information set in the area for the first control information and generating the data so that the data includes the second control information set in the other area as well as the first control information set in the area in the case where the user performs operation with regard to the specific operation of the peripheral unit; and the receiving side group comprises:

a drive unit control device which is provided in association with the drive unit and controls the specific operation of the drive unit on the basis of the first control information included in the data transmitted from the transmitter; and a peripheral unit control device which is provided in association with the peripheral unit and controls the specific operation of the peripheral unit on the basis of the second control information included in the data transmitted from the transmitter.

2. The remote control system according to claim 1, wherein the peripheral unit is provided at the outside of the drive unit as an external device that is separately located independently from the drive unit.

3. The remote control system according to claim 1, wherein the peripheral unit is provided as an internal device, which is built in the drive unit, and at least a portion of the drive unit control device and the peripheral unit control device are used in common therein.

4. The remote control system according to claim 1, wherein the transmitter is provided with a mode changing operation device for receiving a mode changing operation by the user and a mode control device for selecting any one of a drive unit control mode and a peripheral unit control mode in association with an operational condition of this mode changing operation device; and the data generating device generates the data so that the first control information reflects the operational condition of the user with regard to the specific operation of the drive unit in the case of the drive unit control mode and in the case of the peripheral unit control mode, generates the data so that the second control information reflects the operational condition of the user with regard to the specific operation of the peripheral unit and a portion of the first control information maintains a condition included in the first control information before the peripheral unit control mode is selected not depending on the operational condition of the user under this mode.

5. The remote control system according to claim 4, wherein the transmitter is provided with a dual purpose operational device for receiving the user's operation with regard to the specific operation of the drive unit or the specific operation of the peripheral unit; and the data generating device generates the data so that it receives the operation with regard to the dual purpose operational device as the operation with regard to the specific operation of the drive unit and a portion of the first control information reflects the operational condition with regard to the dual purpose operational device in the case of the drive unit control mode and generates the data so that it receives the operation with regard to the dual purpose operational device as the operation by the user with regard to the specific operation of the peripheral unit, the second control information reflects the operational condition with regard to the specific operation of the dual purpose operational device and portion of the first control information maintains a condition reflecting the operational condition of the dual purpose operational device before the peripheral unit control mode is selected in the case of the peripheral unit control mode.

6. The remote control system according to claim 4, wherein the transmitter is provided with a drive unit operating device for receiving the user's operation with regard to the specific operation of the drive unit; and the data generating device generates the data so that a portion of the first control information reflects the operation with regard to the drive unit operating device in any mode of the drive unit control mode or the peripheral unit control mode.

7. The remote control system according to claim 1, wherein the receiving side group in association with one transmitter is capable of containing a plurality of the peripheral units;

the transmitter is provided with a selecting operation device for receiving the user's operation to designate the peripheral unit to be controlled among a plurality of peripheral units;

the data generating device generates the data so that a unit designating information for indicating a designation condition of object to be controlled by the selecting operation device is included in the second control information; and the peripheral unit control device determines whether itself is an object to be controlled or not on the basis of the unit designating information which is included in the second control information, performs the control of the specific operation on the basis of the second control information when determining that itself is an object to be controlled and withholds the control of the specific operation when determining that itself is not an object to be controlled.

8. The remote control system according to claim 4, wherein the receiving side group in association with one transmitter is capable of containing a plurality of the drive units and plurality of the peripheral units, respectively;

the transmitter is provided with a selecting operation device for receiving the user's operation to select arbitrary option among a plurality of options;

the data generating device generates the data so that it receives the operation with regard to the selecting operation device as the operation for designating the drive unit to be controlled among a plurality of the drive units and a drive unit specifying information indicating this designation condition is included in the first control information in the drive unit control mode, generates the data so that it receives the operation with regard to the selecting operation device as the operation for designating the peripheral unit to be controlled among a plurality of the peripheral units and the unit designating information indicating this designation condition is included in the second control information in the peripheral unit control mode and the drive unit specifying information maintains the drive unit specifying information before the peripheral unit control mode is selected not depending on the operational condition of the user with regard to the selecting operation device in the case of the peripheral unit control mode;

the drive unit control device determines whether itself is an object to be controlled or not on the basis of the device unit specifying information which is included in the first control information, performs the control of the specific operation on the basis of the first control information when determining that itself is an object to be controlled and withholds the control of the specific operation when determining that itself is not an object to be controlled; and the peripheral unit control device determines whether itself is an object to be controlled or not on the basis of the unit designating information which is included in the second control information, performs the control of the specific operation on the basis of the second control information when determining that itself is an object to be controlled and withholds the control of the specific operation when determining that itself is not an object to be controlled.

9. The remote control system according to claim 1, wherein the drive unit is constituted as a movable model, the drive unit control device controls the operation of the model on the basis of the first control information; and the peripheral unit is set in a moving range of the model so that it is constituted as an external device for performing a predetermined operation.

10. The remote control system according to claim 9, wherein the model is a model train traveling along a track;

the drive unit control device controls a traveling speed of the model train on the basis of the first control information;

the peripheral unit is a signaler for indicating a travel direction of the model train or a direction of the model train or a rudder capable of changing over a track on which the model train travels, and the peripheral unit control device controls an indication change operation of the signaler or a track change operation of the rudder as the specific operation of the peripheral unit on the basis of the second control information.

11. The remote control system according to claim 9, wherein the model is a model train traveling along a track;

the drive unit control device controls a traveling speed of the model train on the basis of the first control information;

the peripheral unit is a switching unit which is provided with a signaler for indicating a travel direction of the model train and a rudder capable of changing over a track on which the model train travels; and the peripheral unit control device controls an indication change operation of the signaler on the basis of the second control information as well as controls a track change operation of the rudder accompanied by the indication change operation of the signaler.

12. A transmitter for operating a drive unit and a peripheral unit to be used together with the drive unit, which are included in a receiving side group, by remote control with data transmitted repeatedly thereby;

wherein the data transmitted repeatedly includes an area for setting a first control information in association with an operational condition of a user with regard to a specific operation of the drive unit and another area for setting a second control information for controlling a specific operation of the peripheral unit;

the transmitter is provided with a data generating device for generating the data repeatedly so that the data always includes the first control information set in the area for the first control information and generating the data so that the data includes the second control information set in the other area as well as the first control information set in the area in the case where the user performs an operation with regard to the specific operation of the peripheral unit.

13. The transmitter according to claim 12, wherein the transmitter is provided with a mode changing operation device for receiving the mode changing operation by the user and a mode control device for selecting any one of a drive unit control mode and a peripheral unit control mode in association with an operational condition of this mode changing operation device; and the data generating device generates the data so that the first control information reflects the operational condition of the user with regard to the specific operation of the drive unit in the case of the drive unit control mode and, in the case of the peripheral unit control mode generates the data so that the second control information reflects the operational condition of the user with regard to the specific operation of the peripheral unit and a portion of the first control information maintains a condition included in the first control information before the peripheral unit control mode is selected not depending on an operational condition of the user under this mode.

14. The transmitter according to claim 12, wherein the receiving side group in association with the transmitter is capable of containing a plurality of the peripheral units;

the transmitter is provided with a selecting operation device for receiving the user's operation to designate the peripheral unit to be controlled among a plurality of the peripheral units; and the data generating device generates the data so that a unit designating information for indicating a designation condition of an object to be controlled by the selecting operation device is included in the second control information.

15. The peripheral unit to be used as combined with the transmitter according to claim 14, wherein the peripheral unit is provided with a peripheral unit control device which determines whether itself is an object to be controlled or not on the basis of the unit designating information which is included in the data from the transmitter, performs the control of the specific operation on the basis of the second control information when determining that itself is an object to be controlled and withholds the control of the specific operation when determining that itself is not an object to be controlled.

* * * * *